US008046203B2

(12) United States Patent
Blevins et al.

(10) Patent No.: US 8,046,203 B2
(45) Date of Patent: Oct. 25, 2011

(54) METHOD AND APPARATUS FOR ANALYSIS OF ERRORS, ACCURACY, AND PRECISION OF GUNS AND DIRECT AND INDIRECT FIRE CONTROL MECHANISMS

(75) Inventors: William M Blevins, Albuquerque, NM (US); John M Shipman, Albuquerque, NM (US)

(73) Assignee: Honeywell International Inc., Morristown, NJ (US)

( * ) Notice: Subject to any disclaimer, the term of this patent is extended or adjusted under 35 U.S.C. 154(b) by 650 days.

(21) Appl. No.: 12/171,509

(22) Filed: Jul. 11, 2008

(65) Prior Publication Data

US 2010/0010792 A1 Jan. 14, 2010

(51) Int. Cl.
*G06G 7/48* (2006.01)

(52) U.S. Cl. ..... 703/6; 89/41.14

(58) Field of Classification Search ..... 703/6; 89/41.14
See application file for complete search history.

(56) References Cited

U.S. PATENT DOCUMENTS

| | | | | |
|---|---|---|---|---|
| 4,136,467 | A | 1/1979 | O'Rourke et al. | |
| 4,267,562 | A | 5/1981 | Raimondi | |
| 4,402,250 | A | 9/1983 | Baasch | |
| 4,611,772 | A | 9/1986 | Stessen | |
| 4,685,800 | A | 8/1987 | Paquet | |
| 4,926,183 | A | 5/1990 | Fourdan | |
| 5,131,602 | A | 7/1992 | Linick | |
| 5,140,329 | A | 8/1992 | Maughan et al. | |
| 5,267,502 | A * | 12/1993 | Gent et al. | 89/41.03 |
| 5,341,743 | A | 8/1994 | Redaud | |
| 5,379,676 | A | 1/1995 | Profeta et al. | |
| 5,413,029 | A * | 5/1995 | Gent et al. | 89/41.03 |
| 5,556,281 | A | 9/1996 | Fitzgerald et al. | |
| 5,686,690 | A | 11/1997 | Lougheed et al. | |
| 5,745,390 | A * | 4/1998 | Daneshgari | 702/119 |
| 6,037,896 | A | 3/2000 | Dekker | |
| 6,262,680 | B1 * | 7/2001 | Muto | 342/74 |
| 6,283,756 | B1 | 9/2001 | Danckwerth et al. | |

(Continued)

FOREIGN PATENT DOCUMENTS

EP 0 237 223 A1 9/1987

(Continued)

OTHER PUBLICATIONS

Jeff Siewert, "Dispersion Simulation & The Case Against Smooth-Bore Tubes" NDIA Guns & Ammo 2002, pp. 1-17.*

(Continued)

*Primary Examiner* — Dwin M Craig
(74) *Attorney, Agent, or Firm* — Shumaker & Sieffert, P.A.

(57) ABSTRACT

Methods and a system for simulating a weapon system are provided. The weapon system may be modeled using a detailed-error-source description (DESD), with an error term for each error source in the weapon system. A target for the weapon system may be determined. For each simulated shot, each error term in the DESD may be perturbed using a Monte Carlo technique and an impact location of the simulated shot determined. The perturbation of each error term, additional system parameters, and the impact location of each simulated shot may be stored in a system-state data structure. A performance result of the weapon system may be determined. After firing all simulated shots, analysis of the system-state data structure may be performed. Performance results and/or an error-weighting function of the weapon system may be determined based on the analysis.

20 Claims, 11 Drawing Sheets

U.S. PATENT DOCUMENTS

| | | | | |
|---|---|---|---|---|
| 6,386,879 | B1 | 5/2002 | Varshneya et al. | |
| 6,467,388 | B1 | 10/2002 | Malakatas | |
| 6,467,721 | B1 | 10/2002 | Kautzsch et al. | |
| 6,491,253 | B1 | 12/2002 | McIngvale | |
| 6,739,233 | B2 | 5/2004 | Malakatas | |
| 6,805,036 | B2 | 10/2004 | Malakatas | |
| 6,875,019 | B2 | 4/2005 | Huang et al. | |
| 6,937,746 | B2 | 8/2005 | Schwartz | |
| 6,945,780 | B2 | 9/2005 | Perry | |
| 6,973,865 | B1 | 12/2005 | Duselis et al. | |
| 7,052,276 | B2 | 5/2006 | Davidsson et al. | |
| 7,249,730 | B1 * | 7/2007 | Flippen, Jr. | 244/3.15 |
| 7,275,691 | B1 | 10/2007 | Wright et al. | |
| 2002/0197584 | A1 | 12/2002 | Kendir et al. | |
| 2004/0073505 | A1 | 4/2004 | Wright | |
| 2006/0209072 | A1 | 9/2006 | Jairam et al. | |

FOREIGN PATENT DOCUMENTS

| | | | |
|---|---|---|---|
| EP | 1038150 | B1 | 9/2000 |
| EP | 1580517 | A1 | 3/2004 |
| EP | 1643206 | A1 | 4/2006 |
| EP | 1696198 | A1 | 8/2006 |
| WO | 99/60326 | | 11/1999 |

OTHER PUBLICATIONS

Jeff Siewert, "Evaluation of System Effectiveness of Guided Projectiles" NDIA Guns & Missiles 2006, pp. 1-20.*

Military Agency For Standardization (MAS), The Modified Point Mass Trajectory Model, Standardization Agreement (STANAG) 4355, Document No. MAS/24-LAND/4355, Edition 2, Jan. 20, 1997, all pages, NATO.

European Search Report from corresponding EP Application No. 09158753.5, mailed Oct. 2, 2009, 3 pages.

* cited by examiner

800 System-State Data Structure
- 810 Number of simulated shots
- 820 Detailed-error-source description (DESD)
  - 822 Error term for error source 1
  - ...
  - 824 Error term for error source *N*
- 826 Error term flags (one per error term)
- 830 Per-shot data
  - 832 Time of shot
  - 840 Weapon-system data
    - 842 Weapon-system location
    - 844 Targeting data
    - 846 Error values
  - 850 Projectile data
    - 852 Charge level
    - 854 Type of propellant
    - 856 Size of projectile
  - 860 Trajectory data
    - 862 Initial velocity
    - 864 Impact location
- 870 Performance parameters
  - 872 CEP
  - 874 Bias
  - 876 One-sigma value of impact locations
  - 878 Two-sigma value of impact locations
  - 879 MPI
- 880 MET effects data
  - 882 Wind conditions
  - 884 Precipitation level
  - 886 Temperature
  - 888 Humidity
  - 890 Air pressure
  - 892 Visibility Information
  - 894 Time

Figure 8

METHOD AND APPARATUS FOR ANALYSIS OF ERRORS, ACCURACY, AND PRECISION OF GUNS AND DIRECT AND INDIRECT FIRE CONTROL MECHANISMS

GOVERNMENT LICENSE RIGHTS

This invention was made with U.S. Government support under Contract No. DAAE30-03-D-1004 awarded by the Department of the Army. The U.S. Government may have certain rights in this invention.

FIELD OF THE INVENTION

This invention relates to the simulation of weapons fire generally, and specifically in the simulation of artillery fire based on detailed error modeling of gun and associated fire control mechanisms.

BACKGROUND

Ballistics and projectile weapons have been studied, mathematically and militarily, for hundreds, if not thousands, of years. The well-known ballistic equations of motion provide a mathematical model for the ideal trajectory of a projectile fired by a weapon, whether the projectile is a small-arms round or an artillery shot. These equations can be used to predict the location of a projectile impact or "impact location".

Characterizing gun systems may require many experimental trials due to the large number of variables that affect performance. Such systems can be analyzed statistically given sufficiently large sample spaces, which would require firing an infeasible number of artillery shots. Each artillery shot may cost thousands of dollars. Artillery shots are intended to destroy their targets, and as such, typically are only fired on remote, isolated test ranges. Transporting large weapon systems, such as artillery pieces, and a large number of projectiles to a remote location where the weapon can be fired may involve prohibitive expenditures of both time and money. Weapon systems are inherently dangerous—while every effort is made to ensure range safety, some risk to test personnel remains.

Analysis of the precision of artillery systems and their associated error budgets is generally performed using a Root Sum of Squares (RSS) approach. RSS uses a variation value, or standard deviation from a prescribed value, that is determined for each component in a system, to estimate a total error, or accumulation, based on taking a square root of the sum of squares of the standard deviations. A sensitivity analysis may also be performed to arrive at a better estimate. In this case each error component has a relative weight associated with it. This analysis typically involves calculating partial derivatives for each error source in the system. This is often difficult or impossible, if the system cannot be described by a closed form expression.

SUMMARY

Embodiments of the present application include methods and apparatus for analysis of error, accuracy, and precision of weapon systems using modeling and simulation.

A first embodiment of the invention provides a method for determining a performance result of a weapon system. A detailed-error-source description (DESD) of the weapon system is developed. The DESD includes a plurality of error terms. Each error term is a model of an error source of the weapon system. A target of the weapon system is determined. A plurality of error values is generated. Each error value is based on an error term in the DESD. The firing of a shot is simulated based on the plurality of error values. An impact location and the plurality of error values are stored in a system-state data structure. A performance result of the weapon system is determined based on the system-state data structure.

A second embodiment of the invention provides a simulation engine. The simulation engine comprises a processor, a user interface, data storage, and machine language instructions stored in the data storage. The machine language instructions are executable by the processor to perform functions including: (a) determining a DESD of a weapon system, where the DESD comprises an error term for each of N error sources in the weapon system, (b) receiving a target for the weapon system, (c) receiving a number of simulated shots of the weapon system, (d) for each shot in the number of simulated shots: (i) determining an error value for each error term of the DESD, (ii) determining an impact location of the shot, and (iii) storing the error value for each error term and the impact location in a system-state data structure, and (e) determining a correlation matrix based on the system-state data structure.

A third embodiment of the invention provides a method for determining an error-weighting function of a weapon system. The method comprises determining a DESD of the weapon system. The DESD comprises a plurality of error terms. At least one error term in the plurality of error terms comprises a descriptive statistics model of an error source of the weapon system. The number of shots to be simulated is determined. For each shot in the number of shots to be simulated: (i) a plurality of error values are generated using a Monte Carlo technique, (ii) a firing of a shot by the weapon system is simulated to determine the impact location, and (iii) a system state is stored in a system-state data structure. The system state includes the plurality of error values, a plurality of additional system parameters and the impact location. A correlation matrix and a confidence-level matrix are determined based on the system-state data structure. The confidence level for correlations in the correlation matrix is compared to a confidence-level threshold. Responsive to determining that the confidence level of a correlation in the correlation matrix is less than the confidence-level threshold, the correlation is rejected as unreliable. The statistical significance of the correlations in the correlation matrix is determined with respect to a performance parameter. The statistical significance of the correlations in the correlation matrix is compared to a threshold. Responsive to determining that the statistical significance of a correlation in the correlation matrix is less than the significance threshold, the correlation is rejected as insignificant. A plurality of error-source weights for the performance parameter is determined. The plurality of error-source weights are based on each correlation that was not rejected. An error-weighting function for the performance parameter is determined based on the plurality of error-source weights.

BRIEF DESCRIPTION OF THE DRAWINGS

Various examples of embodiments are described herein with reference to the following drawings, wherein like numerals denote like entities, in which:

FIG. 8 is a schematic diagram of an example system-state data structure, in accordance with embodiments of the invention.

DETAILED DESCRIPTION

Figure 1A:
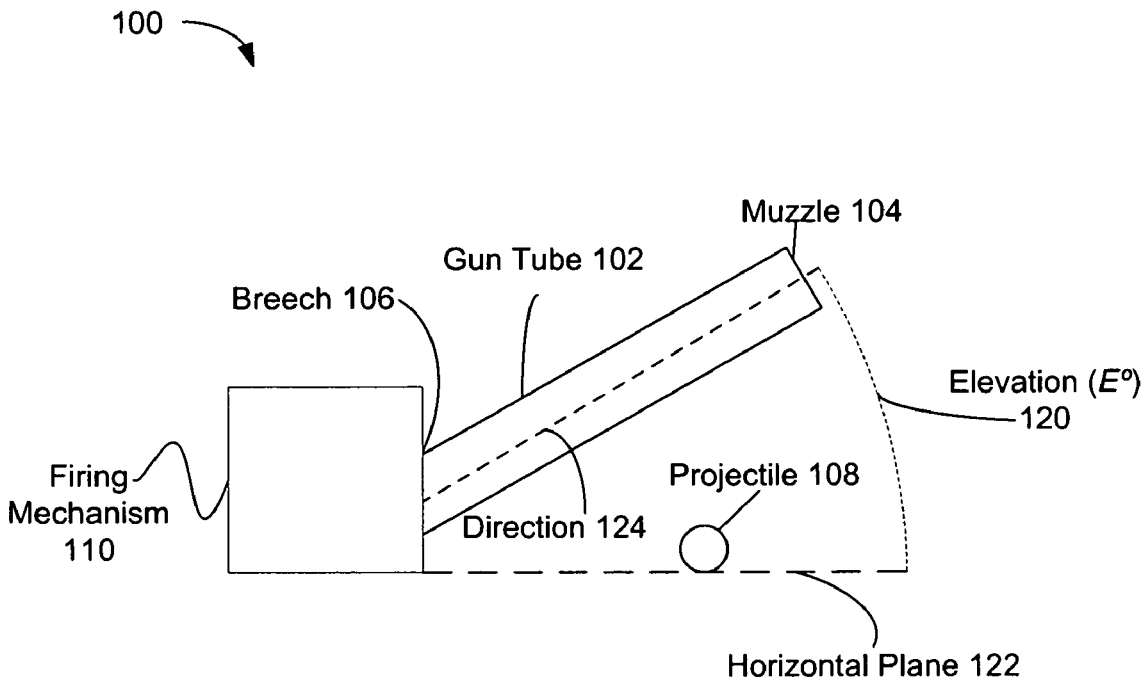
FIGS. 1A and 1B are block diagrams of a side view and a top view, respectively, of an example of a weapon system, in accordance with embodiments of the invention.

Standard methods used to determine and analyze the error budgets of weapon systems, such as Root Sum of Squares (RSS) summations of error distributions or sensitivity analysis, do not provide any insight into the structure and characteristics of the resulting patterns of impact locations. The standard methods do not allow the various error sources that affect accuracy to be studied in the context of the entire system.

The present application describes a simulation engine to perform detailed, mathematically accurate model of weapon systems that allows very large experimental runs, thorough statistical analysis, and characterization at vastly reduced cost without safety risks. Furthermore, a simulation capability is provided that uses the detailed model of weapon systems to enable inexpensive testing of proposed changes or new designs that are impractical using physical gun systems.

The present application provides a method and apparatus for simulating the performance of a weapon system, such as a mortar or artillery piece. A simulation engine performs a simulation of the weapon system using Monte Carlo techniques based on a mathematical model of the weapon system. The simulation engine employs a "ballistic engine" to determine the downrange impact point of the simulated shot using the well-known ballistics equation.

A weapon system may have errors introduced from a variety of sources. Some sources of error include errors in the pointing device which aims the weapon system, the gun tube, the mount of the gun tube, human factors, as well as meteorological (MET) effects, gun and target location uncertainties, propellant variations, boresight errors and others.

To account for these errors, the mathematical model also comprises a detailed-error-source description (DESD). Each error source in the system is characterized. For each characterized error source, an model of the error source or "error term" is developed. The DESD comprises an error term for each error source. As such, the DESD is a detailed description of all error contributions to the weapon system.

In operation, the ballistics engine simulates firing a plurality of shots by the weapon system. The ballistics engine determines a target for the weapon system and a number of shots to be simulated. The ballistics engine may determine an ideal trajectory for a simulated shot fired by the weapon system, using the ballistic equations.

The ballistics engine may determine a "perturbed trajectory" as well. The perturbed trajectory is a trajectory for the simulated shot that takes into account the effects of error sources that "perturb" or modify the flight of the simulated shot from the ideal trajectory. The DESD is used to determine a plurality of "error values" that correspond to each error source included in the DESD. An "error value" is the value of an error term for a given shot.

The error values for a given simulated shot may be determined using a Monte Carlo technique. The error value is chosen at random in accordance with its descriptive statistical behavior. The perturbed trajectory may be determined by modifying the ideal trajectory based on the resulting collection of error values. An impact location of the simulated shot may be determined as well, based on the ideal trajectory or the perturbed trajectory.

The simulation engine may store and analyze the results of the simulation. Performance results of the weapon system may be determined based on the analysis. One such performance result is the impact location of a simulated shot. Other performance results include statistical results, such as a "bias" or accuracy of the weapon system measured by the mean distance of impact location from the target, a "circular error probable" (CEP) that is a radius of a circle, centered at the target, within which 50% of impact locations lie, and standard deviation of a distance between the target and impact locations of simulated shots. Other performance results include graphical performance results, such as a trajectory graph depicting ideal and/or perturbed trajectories of simulated shots, an impact-location graph plotting impact locations of simulated shots, and an analyzed-impact-location graph indicating statistical results along with a plot of impact locations.

The simulation engine may generate a "correlation matrix" and/or an "error-weighting function" based on the stored and analyzed results. The correlation matrix is a P×P matrix, where P=N+M, N is the number of error sources (and thus equals the number of error terms in the DESD), and M is the number of additional system parameters other than errors, such as tube elevation, propellant charge, and the like. The term "correlation-matrix parameter" is used to indicate either one of the N error sources or M additional system parameters; that is, one of the P parameters represented in the correlation matrix. Each entry in the correlation matrix or "correlation" indicates a relationship between two correlation-matrix parameters. In particular, a correlation at location (i,j) of the correlation matrix indicates a statistical correlation between correlation-matrix parameter i and correlation-matrix parameter j.

For example, if i represents a propellant-variation correlation-matrix parameter and j represents a CEP correlation-matrix parameter, the correlation at (i,j) describes the strength of the correlation between propellant variation and CEP. For each correlation, the simulation engine may determine both a confidence level and/or a statistical significance value. A given correlation may be rejected if the confidence level is not sufficiently high and/or the statistical significance value of the correlation is not sufficiently high. Then, the simulation engine may process the remaining correlations to determine which error sources have a relatively significant effect on the performance of the weapon system. One technique to reject a correlation whose confidence level is not sufficiently high and/or whose statistical significance value is not sufficiently high is to set the correlation to zero. Other techniques to reject a correlation are possible as well.

The simulation engine may characterize, quantify, and rank sources of error according to their contribution to performance of the weapon system. The simulation engine may characterize, quantify, and rank sources of error by determining their relative contribution or "weights" in an error-weighting function. A weight in the error-weighting function may be determined for each error source with a relatively significant effect on the ideal trajectory. As such, the error-weighting function may indicate how the relatively significant error sources affect the performance of the weapon system. Further, the error-weighting function may, in combination with the ballistic equations of motion, predict an actual trajectory of a shot fired using the weapon system by providing an accurate model of the perturbations from the ideal trajectory induced by errors in the weapon system.

The use of a simulation engine that simulates weapon system performance using the DESD and ballistic trajectory calculations may provide unexpected results as well. These unexpected results accrue from being able to cheaply and easily test the performance of a weapon system, where large sample spaces or repeated testing is otherwise infeasible. The method may result in the discovery of system characteristics not predicted by standard analytical tools. An example would be the impact pattern eccentricities that develop from the synergistic effects of the entire weapon system on performance. Use of Monte Carlo techniques provides an unbiased method of determining the performance of systems comprised of large numbers of variables that interact in a complex fashion, unlike worst-case, RSS, or sensitivity analysis methods.

The use of a simulation engine combined with a detailed error-source description facilitates rapid development and testing of proposed design changes. For example, to test a proposed gun mount, the appropriate error-source functions for the proposed gun mount may be used as part of a new DESD. The ballistics engine may simulate a number of shots which may then be fired using the new DESD. Then, the results of using the proposed gun mount, including impact locations, bias, CEP, and standard deviation of the targets, can be compared to a similar simulation without the proposed modifications. The cost is greatly reduced in comparison to manufacturing and test firing of the proposed gun mount, which need not be undertaken until the design change is validated in simulation. Further, safety may be improved as well, as fewer actual shots need be fired to test a weapon system.

Figure 1B:
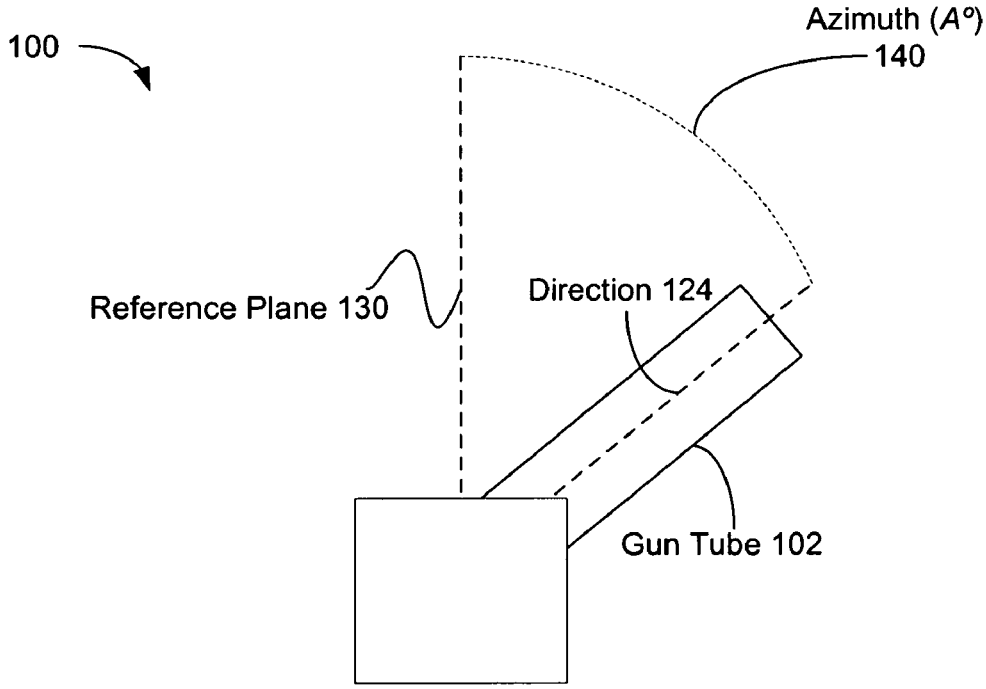

Turning to the figures, FIGS. 1A and 1B are block diagrams of a side view and a top view, respectively, of a weapon system 100, in accordance with embodiments of the invention. FIG. 1A shows the weapon system 100 with a gun tube 102 having a muzzle 104, a breech 106, and a firing mechanism 110. The weapon system 100 may be used to fire one or more projectiles, such as projectile 108. A soldier or other user of the weapon system 100 may insert the projectile 108 into the firing mechanism 110, typically via a door (not shown) in the firing mechanism 110 providing access to the breech 106 of the gun tube 102, in the case of breech loaded weapons, or into the muzzle 104 in the case of muzzle loaded weapons (such as mortars). The soldier may fire the weapon system 100 causing the projectile 108 to leave the weapon system 100 via the muzzle 104 to travel on a trajectory. After traveling on a trajectory, the projectile 108 may impact at an impact location.

The weapon system may be aimed at a target. The target of the weapon system may be specified in terms of two angles: an "elevation" and an "azimuth". The elevation of a weapon is the angle between a horizontal plane representing the ground and a direction of a gun tube of a weapon system. FIG. 1A shows an elevation 120 of E° for the weapon system 100. FIG. 1A depicts the elevation 120 as a dashed line indicating the angle between a horizontal plane 122 running along a bottom of the weapon system 100 and a direction 124 of the gun tube 102 of the weapon system 100. The elevation may be expressed in angular units such as degrees, radians, or as a quadrant elevation (QE). The QE may be expressed in terms of degrees or "mils" or units of rotation. (There are 6,400 mils of rotation in a circle; for example, a QE of 800 mils corresponds to a 45° angle.)

The azimuth indicates a direction of fire for the weapon system (i.e., the direction of the barrel of the weapon system) expressed as an angle from a reference plane, such as true north. FIG. 1B indicates an azimuth 140 of A°. FIG. 1B depicts the azimuth 140 as a dashed line, indicated with respect to a reference plane 130 and a direction of a gun tube 124. The azimuth may be expressed in angular units such as radians, degrees, or in mils. Another term for the azimuth is "deflection". The term deflection often is used when the azimuth is expressed in mils.

To simulate weapons fire by a weapon system, various input parameters are provided to a simulation engine. To specify a target, the location, elevation, and the azimuth of the weapon system are provided as input parameters. The number of shots to be simulated may be provided as an input parameter. A DESD or other model of error sources within the weapon system may be provided as an input parameter. Various characteristics of a simulated projectile may be provided as input parameters, such as the size of the simulated projectile, the type of propellant used by the simulated projectile, and/or amount of propellant or "charge level" of the simulated projectile. A model of "MET effects" or meteorological conditions such as temperature, wind, and precipitation, may comprise one or more input parameters to the simulation engine as well. As used in the present application, "MET" is a term of art for "meteorological conditions". Some or all of the input parameters may be provided to the ballistic engine component of the simulation engine.

The ballistic engine may use a mathematical model of ideal system behavior. In the context of a weapon system, the mathematical model is the ballistic equations of motion used to determine the "exterior ballistics trajectory" or "ideal trajectory" for the path or flight of the projectile. NATO Standardization Agreement 4355, which is incorporated herein by reference, provides the standard modified point-mass trajectory model for exterior ballistics trajectory determination of artillery projectiles for NATO Naval and Army forces. [NATO Military Agency for Standardization, NATO Standardization Agreement 4355, Subject: The Modified Point Mass Trajectory Mode, p. 1, Revision 2, Document No. MAS/24-LAND/4355, Jan. 20, 1997 ("STANAG 4355").] Other mathematical models for exterior ballistics are known, such as the '4 Degrees of Freedom' (DOF) model and the 6 DOF model. Any of these may be employed as an additional embodiment of the method described herein.

The ballistic engine may be instructed to vary some or all input parameters either on a per-shot basis or after a fixed number of simulated shots. For example, the simulation engine may be instructed to change the target of the weapon, select one of a plurality of DESDs for modeling error in the weapon system, modify the charge of the projectile, and/or to vary the model of meteorological conditions during a simulation.

Figure 2:
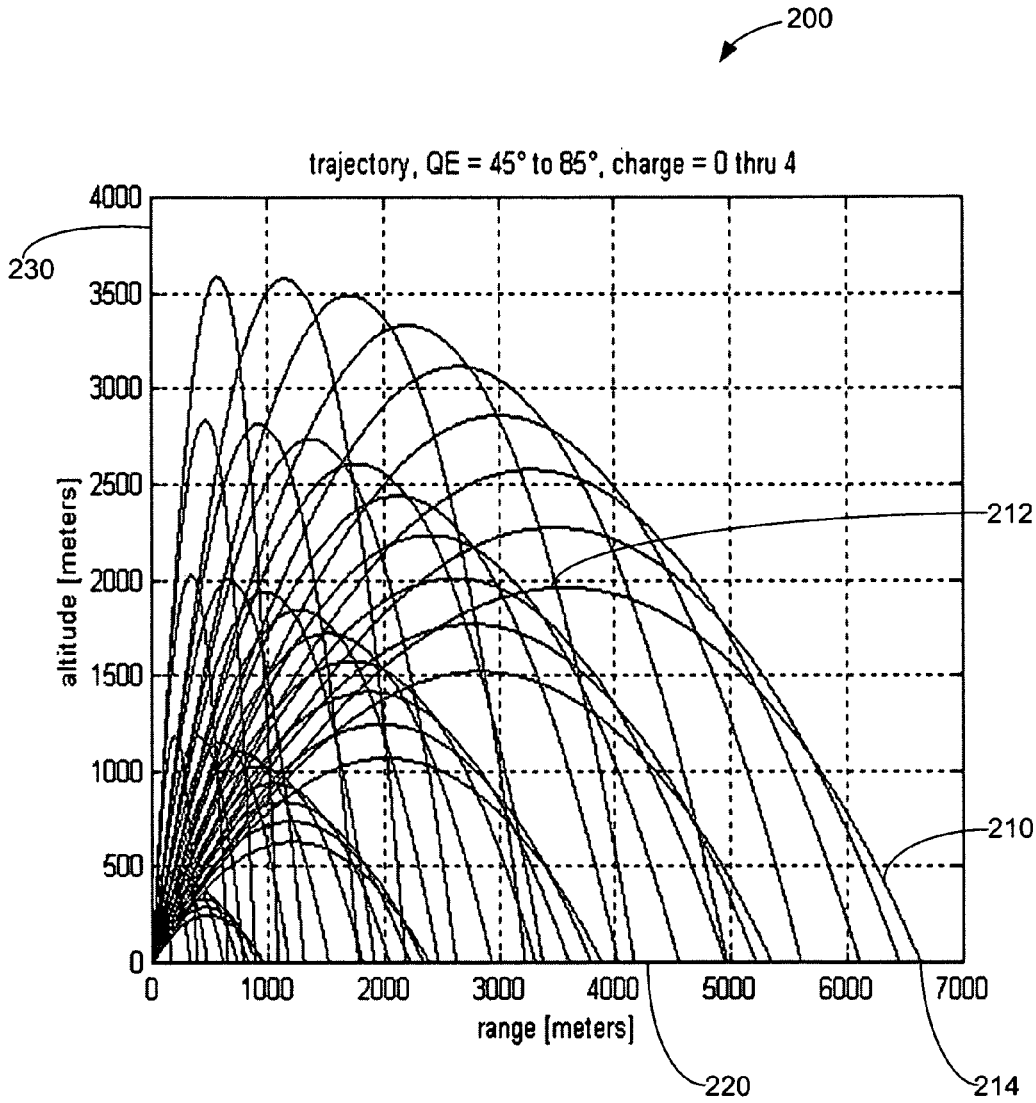
FIG. 2 depicts an example of ideal trajectory series, in accordance with embodiments of the invention.

FIG. 2 depicts an ideal trajectory graph 200, in accordance with embodiments of the invention. The ideal trajectory graph 200 describes trajectories, elevation description (e.g., QE varies from 45° (or 800 mils) to 85° (or approximately 1511 mils)), and charge description (e.g., the charge for a propellant varies from 0 to 4 units).

An ideal trajectory, such as trajectory 210, may be determined by solving the ballistic equations of motion based on given input parameters. FIG. 2 shows trajectory 210 reaching a maximum height 212 and then ending at an impact location 214. Trajectory 210 is a trajectory based on the solution of the ballistic equation of motion for a given weapon system fired with a QE of 45° and a charge of 4. FIG. 2 shows the ideal trajectory graph 200 with a range axis 220 and an altitude axis 230. The range axis 220 indicates the range, which is the distance a projectile travels from the weapon system in the direction of fire, to the impact location. FIG. 2 shows that a projectile traveling along ideal trajectory 210 reaches an altitude of 0 at impact location 214 approximately 6,750 meters from the location of the weapon system. The altitude axis 230 indicates a height above the location of the weapon system that a projectile reached while traveling along a trajectory. FIG. 2 shows a projectile traveling along ideal trajectory 220 reaching a maximum height 212 of slightly less than 2,000 meters.

To simulate the firing of one shot, the ballistic engine uses the input parameters provided to determine an ideal trajectory for the shot. To consider the effects of error sources on the ideal trajectory, a plurality of error values may be generated. Each error value may correspond to an error source of the weapon system. Each error source in the system is characterized and a descriptive statistics model for the variation of that error source developed. Let N be the number of error sources in the weapon system. Then, the DESD may comprise an error value for each of N error sources in the weapon system. Thus, each error source represented in the DESD may be modeled independently.

An error term may comprise a "descriptive statistics model" of a given error source. A descriptive statistics model is a function of one or more variables. Examples of descriptive statistics models are a Gaussian (i.e., normal) distribution of expected variation, a bimodal distribution of expected variation, and a uniform distribution of expected variation. Also, custom descriptive statistics models of expected variation may be used as error terms.

In addition, error terms that model error sources, but are not descriptive statistics models may be used as error terms for the DESD as well. One such model is a collection of empirical data. For example, empirical data may be measured and collected, such as multiple measurements of motion in a component of the weapon system 100 (e.g., a bipod). The resulting collection of empirical data may be stored in a data structure suitable for storing and/or organizing the empirical data, such as a lookup table or one or more relations in a relational database. Then, the collection of empirical data may be used as an error term. For example, the index (or indices) to the data structure storing the collection of empirical data could be treated as input parameters to an error term.

To generate the plurality of error values for simulation, a Monte Carlo technique may be used. Generally, Monte Carlo techniques involve the use of random or pseudo-random numbers. An example Monte Carlo technique for determining an error value corresponding to a descriptive statistics model in the DESD is: (1) determine a random (or pseudo-random) value for each input parameter of the DESD based on its statistical behavior, (2) determine a corresponding unique collection of individual variations for that particular experimental trial (i.e., a particular shot of the weapon system), and (3) use the resulting DESD as the error values for the ballistic simulation.

For example, assume that ES is one of N error sources such that $1 \leqq ES \leqq N$. Further assume the possible values for error source ES compose a uniform zero-mean distribution ranging from −5 to +5 in arbitrary units. Each experimental trial would generate a new value of ES as a function of a variable i such that i occurs with equal probability on the range $0 \leqq i \leqq 1$ and $ES=(i*10)-5$. The standard deviation for this parameter would then be 2.8865, which completes the descriptive statistics model for that error source. The new value of ES is then incorporated into the DESD for the current simulation iteration to model the variation of the error parameter in question. Additional error terms may employ other descriptive statistical distributions (e.g., bi-modal, normal, etc.) based on the characterization of the source of system error.

This Monte Carlo technique may be repeated to determine an error value for each error term in the DESD. Note that this Monte Carlo technique may be used to generate a different set of error values for each simulated firing of a shot by the weapon system, as each error value is determined by random (or pseudo-random) variation in accordance with its descriptive statistics model.

For many error sources, each error term may be represented by a descriptive statistics model of one variable and, in particular, the one variable may range over a fixed range of values. As such, the DESD may comprise a plurality of error terms, where each error term is a function of one variable x, where x is in the range of [a,b] for each error term in the DESD, for fixed real numbers a and b (e.g., x is in the range [0,1]). However, more complex error sources may require multivariate functions to model their statistical behavior. The DESD may then comprise a combination of single-variable or multivariate error terms to describe the required characteristics. The DESD may comprise one or more collections of empirical data—in that case, the values of x would be treated as index values for a collection of empirical data indexed using a single index.

A Monte Carlo technique to determine a particular error value for each error term of the DESD may comprise: (a) generating one or more random numbers such that each random number value falls within the distribution described by a corresponding input parameter to an error term in the DESD, and (b) using the one or more generated random number(s) to model the variability of the given error term for that simulation iteration, and (c) repeating procedures (a)-(b) for each error source represented in the DESD.

The error values may be used to modify the ideal trajectory to simulate the firing of a shot by the weapon system with its associated errors. In particular, a perturbed trajectory may be determined. The perturbed trajectory is a trajectory that simulates the cumulative effect of all error sources in the DESD on the ideal trajectory. As such, the perturbed trajectory may be determined by modifying the ideal trajectory based on a plurality of error values, where each error value for a given shot is determined by applying a Monte Carlo technique to vary an error term in accordance with its descriptive statistics model specified in the DESD. Based on the perturbed trajectory, an impact location of the simulated shot may be determined.

Each of the error sources in the DESD may be enabled or disabled. Providing the ability to enable or disable one or more error sources permits examination of a smaller set of error sources as may be required for a detailed examination of one or more aspects of the weapon system. One method of disabling an error source is to set the error term of the error source to a constant; i.e., using a descriptive statistical formula for the error source that has an output of a constant value regardless of input value(s) such as $ES(x, y, z)=4$. For a collection of data, each value in the data structure storing the collection of data may be the constant. Then, the same value (the constant) is returned regardless of input value(s) (i.e., index values).

If a model of MET effects is implemented, the simulation engine may determine the perturbed trajectory based on the model of MET effects as well. One or more elements of the model of MET effects may be enabled or disabled as well. For example, if the effect of wind is to be studied in isolation, the temperature value in the model of MET effects may be set to a constant (e.g., 20° C.).

A system state comprises the information used in simulating performance of a weapon system and the associated downrange results. All variables used to simulate a firing of a shot may be stored in a system-state data structure. For example, for a given shot, the system-state data structure may store the particular variations of each error source in the weapon system, the target and location of the weapon system, the charge for the projectile fired, a model of MET effects, the perturbed trajectory of the shot, and the "impact location" or the location where the shot landed. The distance from the impact location to the target may be determined. At the end of a simulation, the system-state data structure may store all variables for each shot out of the number of simulated shots.

An Example Method for Determining a Performance Result of a Weapon System

Figure 3:
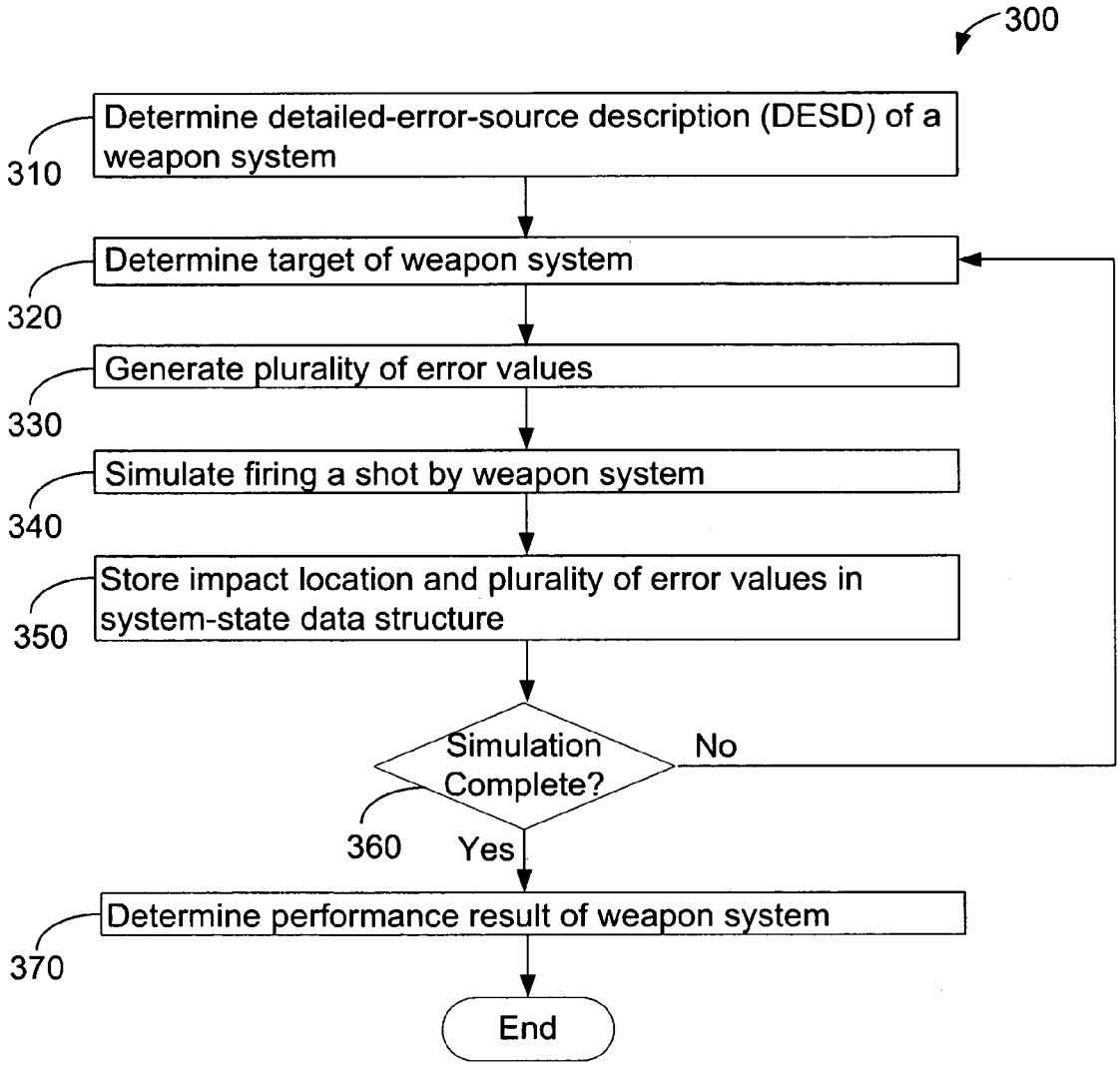
FIG. 3 is a flowchart of an example method, in accordance with embodiments of the invention.

FIG. 3 is a flowchart of an example method 300, in accordance with embodiments of the invention. It should be understood that each block in this flowchart and within other flowcharts presented herein may represent a module, segment, or portion of computer program code, which includes one or more executable instructions for implementing specific logical functions or steps in the process. Alternate implementations are included within the scope of the example embodiments in which functions may be executed out of order from that shown or discussed, including substantially concurrently or in reverse order, depending on the functionality involved, as would be understood by those reasonably skilled in the art of the described embodiments.

Method 300 is a method for determining a performance result of a weapon system. Method 300 may be performed by a simulation engine. The functions of a weapon system and/or a simulation engine may be performed by computer software configured to execute some or all of the steps of hereindescribed method 300. The computer software for a weapon system and/or a simulation engine may be executed on a computing device, such as computing device 500.

Method 300 begins at block 310. A DESD of the weapon system may be determined. The DESD may be a data structure, data object, or other source of information configured to model a plurality of error sources in a weapon system. The DESD may be a stand-alone data structure or may be part of a larger data structure, such as detailed-error-source-description in system-state data structure 722 described with reference to FIG. 7 below. The DESD may comprise an error term for each error source in the plurality of error sources. Each error term may model an error source of the weapon system. Each error term may use a descriptive statistics model of expected variation to model the error source, such as a normal distribution of expected variation, a bimodal distribution of expected variation, or a uniform distribution of expected variation. Custom descriptive statistical formulas of expected variation, such as arithmetical, algebraic and/or statistical combinations of the above-described distributions of expected variation, may be used as well.

At block 310, the simulation engine may be initialized as well. In particular, a number of shots N1 to be simulated may be initialized, such as by user input, and a current number of simulated shots may be initialized (i.e., set to zero) as well.

At block 320, the simulation engine may determine a target of the weapon system. The target of the weapon system may be determined based on user input, such as providing azimuth, elevation and propellant charge information to the simulation engine. Other user input, such as a location of the weapon system, meteorological effects data, and/or a number of simulated shots, may be used by method 300 as well. The target may be determined algorithmically as well, such as by specifying a location on the geodetic grid.

The target may be the same throughout all N1 shots or may vary throughout the simulation. The target may vary depending on the current number of shots simulated, an amount of time consumed by the simulation, or for many other reasons.

At block 330, the simulation engine may generate a plurality of error values. The simulation engine may generate an error value for each error term in the DESD. The simulation engine may generate an error value using a Monte Carlo technique.

Each error term in the DESD may be enabled or disabled. If an error term is disabled, the simulation engine may not perturb the nominal value for that error term. The nominal value is a constant equal to the mean value of a range of variation for the error term. If an error term is enabled, the simulation engine may determine an error value that differs from a nominal value and is based on the corresponding distribution of the error term. An error term may be enabled to include the effect of a particular error source on the performance of the weapon system. An error term may be disabled to focus the simulation and analysis on other error sources.

At block 340, the simulation engine may simulate firing of a shot. To simulate firing of the shot, the simulation engine may determine an ideal trajectory and/or a perturbed trajectory of the shot. The simulation engine may use the ballistic equations of motion to determine an ideal trajectory of the shot. The simulation engine may determine a perturbed trajectory by modifying the ideal trajectory based on the plurality of error values generated in block 330. Once the trajectory of the shot (either ideal or perturbed) is determined, an impact location of the shot may then be assigned based on the determined trajectory.

At block 350, the simulation engine may store the system state in a system-state data structure. The system-state data structure may be the system-state data structure. The data stored in the system-state data structure 722 may be the data described in FIG. 7. A shot has been simulated when the procedures of blocks 320-350 have been completed. As such, the current number of simulated shots may be incremented at the end of block 350 as well.

At block 360, the simulation engine may determine if the simulation is complete. For example, the simulation engine may compare the current number of simulated shots to N1 and may determine the simulation is complete if the current number of simulated shots is greater than or equal to N1. Many other methods of determining that the simulation is complete are possible as well. If the simulation engine determines the simulation is complete, method 300 may proceed to block 370. If the simulation engine determines the simulation is not complete, method 300 may proceed to block 320.

At block 370, the simulation engine may determine a performance result of simulated firing of the weapon system. A performance result of simulated firing of a weapon system may comprise: (a) one or more impact locations of one or more shots fired by the weapon system, (b) one or more perturbed and/or ideal trajectories of one or more shots fired by the weapon system, and/or (c) a statistical analysis of impact locations of shots fired by the weapon system, such as determination of a standard deviation of impact locations, a CEP, and/or a bias of the weapon system. The performance result may be displayed textually and/or graphically. The performance result may comprise a trajectory graph, such as the ideal trajectory graph 200, an impact-location graph, and/ or an analyzed-impact-location graph. Performance results are described in more detail with reference to FIG. 2 above and FIGS. 4-6 below.

The performance result may be displayed to a user of a simulation engine; for example, by displaying a graphical and/or textual performance result on output unit 734 of computing device 700 executing software that implements the functions of a herein-described simulation engine. Computing device 700 is described below with reference to FIG. 7.

After completing block 370, method 300 ends.

Example Performance Results

Figure 4:
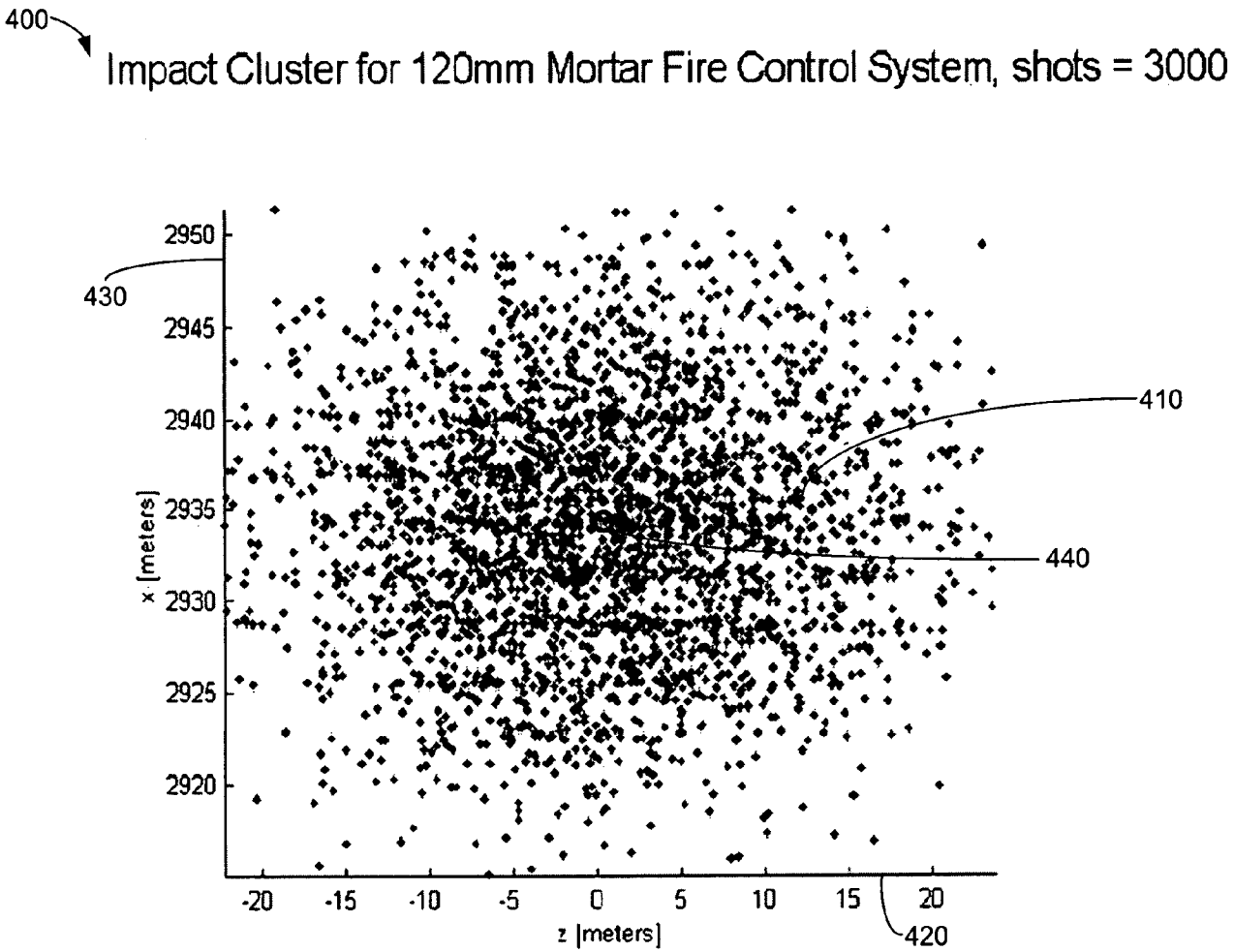
FIG. 4 depicts an example performance result of simulated firing of a weapon system, in accordance with embodiments of the invention.

FIG. 4 depicts an example performance result of simulated firing of a weapon system, in accordance with embodiments of the invention. A performance result of simulated firing of a weapon system may be an impact-location graph indicating one or more impact locations of simulated shots fired by a weapon system. FIG. 4 shows impact-location graph 400 displaying impact locations 410 plotted on a horizontal axis 420 and a vertical axis 430. The impact-location graph 400 indicates a 120 mm mortar weapon system was simulated and that 3000 shots were fired in the simulation.

An impact-location graph may be a plot of impact locations on a set of axes. FIG. 4 shows impact locations 410 plotted on a set of axes, with the horizontal axis 420 indicating distance from the center of impact locations 410, and the vertical axis 430 indicating range.

FIG. 4 shows horizontal axis 420 plotted with zero approximately centered along the axis such that the horizontal axis indicates the deviation of impact locations 410 from the azimuth of fire. The impact-location graph 400 shows a target 440 for a weapon system. A mean point of impact (MPI) may be indicated on the impact-location graph as well as, or instead of, a target. The MPI may indicate an average point of impact of a collection of impact locations. To determine the MPI, each coordinate of the impact locations may be averaged independently. For example, suppose three impact locations are recorded using [x,y] coordinates: (5,14), (5.5, 14.5), (4.8,14.1). For the example impact locations, the average x-coordinate value is 5.1, the average-coordinate value is 14.2, and thus the coordinates of the MPI are (5.1, 14.2).

Error Weighting Function

An "error weighting function" may also be developed from the weapon system simulation. This post-processing step involves generation of a matrix of correlation coefficients. The correlation matrix is a P×P matrix, where N=the number of error terms characterized in the DESD, M=the number of additional system parameters other than error sources, and P=N+M or the total number of correlation-matrix parameters. The correlation matrix comprises a plurality of correlation entries. Each entry in the correlation matrix or "correlation" may indicate a statistical relationship between two correlation-matrix parameters. The terms "correlation coefficient" and "correlation" are used interchangeably in this application.

The correlation is a measure of the "strength" of the association of any two correlation-matrix parameters in the statistical sense, and takes on values that range from zero to one (or −1 for an inverse correlation). A value of 0 suggests complete independence, or "zero correlation" between two system parameters (e.g., muzzle velocity and azimuth error, which is the difference in azimuth between an impact location and the target). A value of 1 indicates the correlation-matrix parameters always vary in tandem (e.g., muzzle velocity and range error, which is the difference in range between an impact location and the target). The correlation may depend on the number of experimental trials, or, in the context of the herein-described simulation engine, the number of simulated shots. In general, as the number of shots in a system simulation increase, the associated correlation values converge to some final result such that further increases in the shot number yield no further refinement of the correlations.

In particular, the correlation at location (i, j) of the correlation matrix specifies the independence of the $i^{th}$ and $j^{th}$ correlation-matrix parameters in the statistical sense. A correlation at location (i, j) in the correlation matrix will be the same as the correlation value at location (j, i) in the correlation matrix. As such, the correlations related to a given correlation-matrix parameter i may be found along either the $i^{th}$ row or $i^{th}$ column of the correlation matrix.

Based on the results of the analysis of the system-state data structure, the simulation engine may determine an error-weighting function of the weapon system. For each correlation in the correlation matrix, the simulation engine may determine both a confidence level and/or a statistical significance value.

A confidence level is the probability that a given correlation did not occur by chance. The confidence level may depend on the number of experimental trials, or, in the context of the herein-described simulation engine, the number of simulated shots. In general, a greater number of shots yield a more reliable correlation result.

A confidence level for each correlation in the correlation matrix may be determined. The confidence levels may be stored in a confidence-level matrix. Each confidence level in the confidence-level matrix may correspond to a correlation in the correlation matrix. For an example correspondence, the confidence level at location (i,j) of the confidence-level matrix may be the confidence level of the correlation at location (i,j) of the correlation matrix. Other correspondences are possible as well.

If the confidence level for a correlation between two system parameters is less than a confidence-level threshold value, the simulation engine may reject the correlation as unreliable. If the correlation is less than some threshold value, the simulation engine may reject the correlation as not statistically significant. These thresholds may be assigned any desired value. In one embodiment of the invention, a confidence threshold value indicates a 95% confidence level and a significance threshold may indicate a correlation coefficient of 0.6 or higher.

In an embodiment of the invention, any desired subset of a system-state data structure generated by the simulation engine may be analyzed using the same techniques for analyzing the full system-state data structure. This reduces processing time when working with large datasets, and eliminates the need to repeat some experiments based on new requirements. For example, restricting the determination of system performance to maximum range fire missions may be accomplished by processing only those states for which tube elevation is 45° and propellant charge is at its maximum value.

The reliable and statistically significant correlation-matrix parameters that remain can be used to formulate an "error weighting function" for the weapon system's sensitivity to any of a plurality of performance parameters. Example performance parameters are the accuracy (bias), precision (CEP or standard deviation), azimuth error, and range error. For example, the reliable and statistically significant correlation-matrix parameters that affect precision may be used to generate an error weighting function for the CEP.

Statistical results describing weapon system characteristics and performance may be determined during post-simulation analysis. One important performance parameter for gun systems that the simulation engine can determine is accuracy or "bias". The simulation engine may determine bias as the distance between the mean point of impact (MPI) for all experimental trials (shots) as determined above and the intended target. For simulations of a single shot, the bias is simply the distance between the impact point and the target.

Another important performance parameter is precision, which is a measure of the repeatability of the system under test (in this case it can also be thought of as the degree of scattering of impact locations around the target(s) of the weapon system). Precision is generally specified in terms of standard deviation, and as CEP when speaking of gun systems. The simulation engine may determine CEP as the radius of a circle centered at the target that contains 50% of all impact locations. The simulation engine may also determine the precision in terms of standard deviation of the impact locations for a given simulation. The simulation engine may determine the standard deviation s using the following function:

$$s = \sqrt{\frac{1}{N}\left(\sum_{i=1}^{N}(x_i - T)^2\right)}$$

where:

N is the number of simulated shots, $x_i$ is the impact location for a given shot i, and T is the target location.

If the collection of simulated impact locations approximates a normal distribution, then a one-sigma value and/or a two-sigma value may be determined. Approximately 68.3% of a normal distribution of impact locations will be within a circle whose radius is one standard deviation, or one-sigma and approximately 95.4% of a normal distribution of impact locations will be within a circle whose radius is two standard deviations, or two-sigma. The simulation engine may determine the one-sigma and/or two-sigma values by processing the system-state data structure.

The simulation engine may identify correlation-matrix parameters that meet the threshold requirements and influence the particular aspect of system performance being investigated. The corresponding collection of correlation coefficients is normalized and the resulting values assigned as sensitivity terms (or weights) for each of the sources of variation (or error). For example, suppose three sources (a, b, c) of system error have three corresponding correlation coefficients (0.9, 0.63, 0.7) with respect to simulation results for CEP. The normalized values would then be (0.40, 0.28, 0.31) and the simulation engine may determine the CEP error weighting function to be CEP(a,b,c)=0.40a+0.28b+0.31c. Parameter 'a' is likely responsible for around 40% of the observed impact errors, whereas 'b' and 'c' are assigned 28% and 31% respectively. These results may be used to inform design decisions and cost/benefit analyses.

To continue with the example above, suppose that for a redesign study it was determined that the cost to improve CEP was $1 per meter for each of the error weighting function parameters a, b and c. Clearly it is best to put the resources into improvements on 'a', since each dollar spent should yield a 0.4 meter improvement in CEP (as compared with 0.28 meters and 0.31 meters respectively for 'b' and 'c'). However, if the relative costs to improve CEP are $2/meter for 'a', $0.75/meter for 'b' and $1/meter for 'c', then redesigning the error source represented by 'b', then 'c' and 'a' last is the optimal strategy, since it should yield 0.38 meters of CEP reduction for each dollar spent on 'b' (as compared with 0.20 meters and 0.31 meters respectively for 'a' and 'c').

Figure 5A:
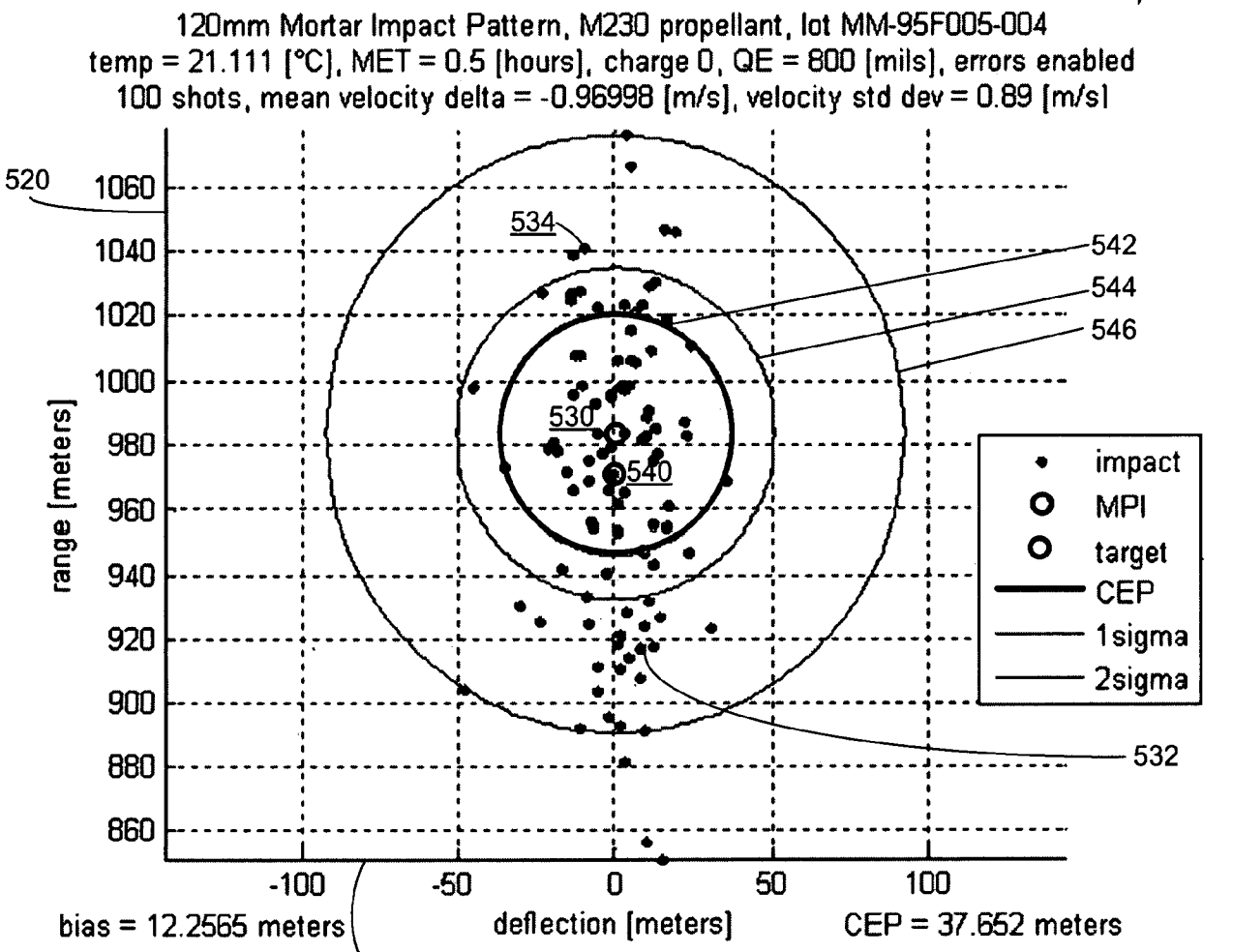
FIGS. 5A and 5B depict example performance results comprising statistical analysis of simulated firing of a weapon system, in accordance with embodiments of the invention.
Figure 5B:
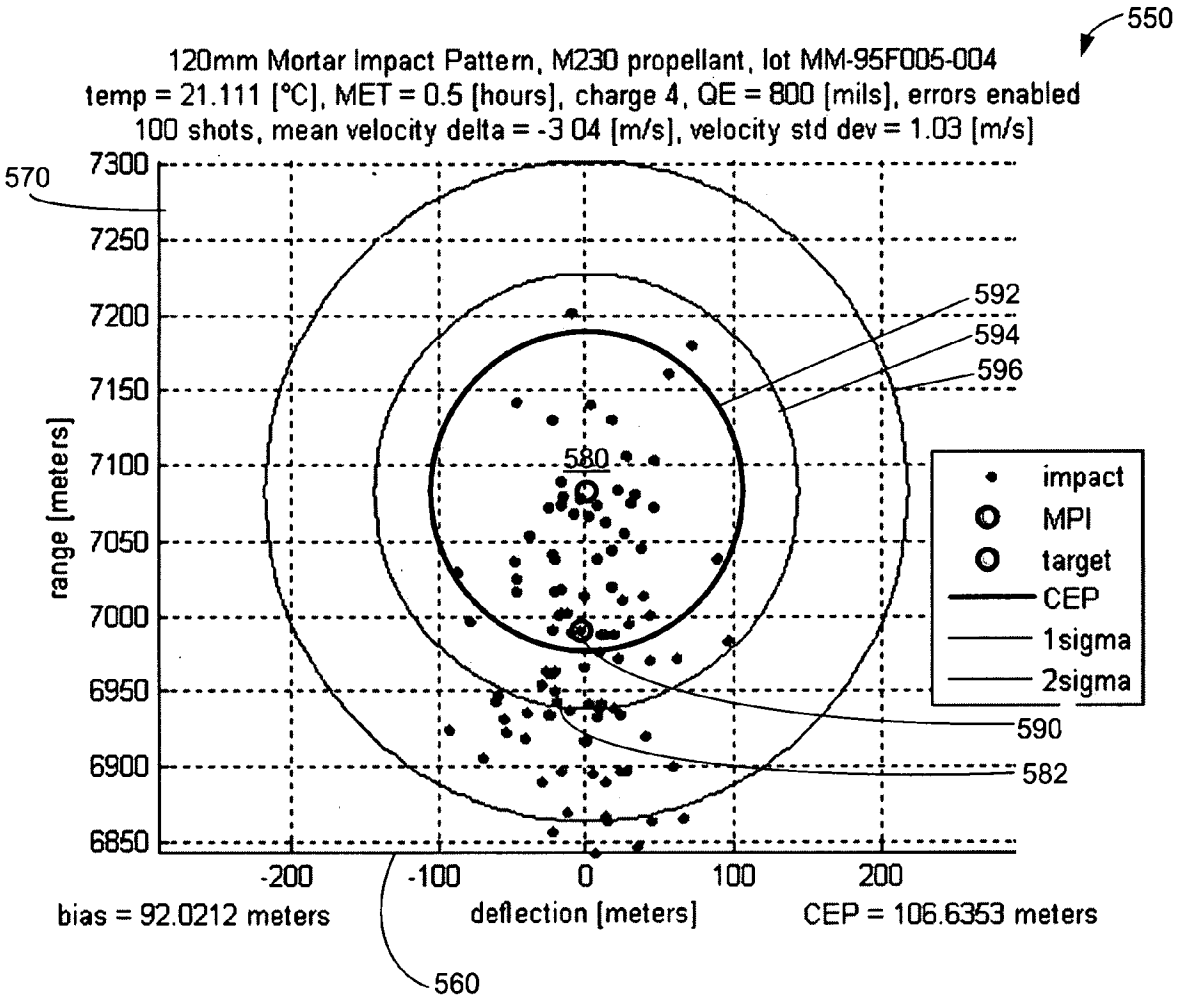

FIGS. 5A and 5B depict example performance results of simulated firing of a weapon system comprising statistical analysis, in accordance with embodiments of the invention. A performance result of simulated firing of a weapon system may be an impact-location graph indicating one or more impact locations of simulated shots fired by a weapon system. FIG. 5A depicts an analyzed-impact-location graph 500 with a deflection axis 510, a range axis 520, a target 530, impact locations 532, an MPI 540, a CEP ring 542, a one-sigma circle 544, and a two-sigma circle 546.

FIG. 5A shows the analyzed-impact-location graph 500 indicating a simulated weapon system of a "120 mm Mortar", the use of "M230 propellant" at "charge 0" for the simulated projectiles fired by the weapon system. The meteorological conditions included a temperature of "21.111 [° C.]" at a reference time of "MET=0.5 [hours]." Targeting information included a quadrant elevation of "QE=800 [mils]." Simulation information included an "errors enabled" indication that error terms in the DESD are enabled during this simulation. FIG. 5A indicates the bias of the simulated weapon system as "bias=12.2565 meters" and the CEP as "CEP=37.652 meters".

The analyzed-impact-location graph 500 displays a target 530 as a relatively thick circle. FIG. 5A shows the impact locations 532 plotted on a deflection axis 510 and a range axis 520. FIG. 5A shows the horizontal deflection axis 510 of analyzed-impact-location graph 500 indicating the deflection of the impact locations 532. For example, FIG. 5A shows specific impact location 534 is approximately 6 meters to the left of target 530, or has a deflection of approximately 6 meters. The deflection axis 510 may use a convention where shots to the left of the target have a negative deflection, and shots to the right of the target have a positive deflection (or vice versa). Using the convention where shots impacting left of the target have a negative deflection, specific impact location 534 has a negative deflection of approximately 6 meters.

FIG. 5A shows range axis 520 indicating a range for each impact location. The range of an impact location may be used to determine the distance the impact location is from the target in a vertical direction. For example, FIG. 5A shows specific impact location 534 has a range of approximately 1040 meters and target 530 has a range of approximately 982 meters. Therefore, specific impact location 534 has distance of approximately 58 meters in the vertical direction from target 530.

An analyzed-impact-location graph may graphically indicate statistical results, such as a MPI, CEP, and/or standard deviation information. FIG. 5A shows an MPI 540, a CEP ring 542 and standard deviation rings 544 and 546 of analyzed-impact-location graph 540. The MPI may be different from a target, such as the MPI 540 shown in FIG. 5A as distinct from the target 530.

A CEP ring may indicate a circle enclosing approximately 50% of a series of impact locations, such as the CEP ring 542 shown in FIG. 5A. A standard-deviation ring may indicate a circle enclosing a series of impact locations within one or more standard deviations of a series of impact locations. FIG. 5A shows one-sigma circle 544 and two-sigma circle 546 as circles enclosing impact locations 532 that are within one standard deviation and two standard deviations, respectively, of target 530.

An eccentricity analysis may be performed on one or more impact locations. An eccentricity analysis may comprise determining a major and/or minor axis of a bounding ellipse for a cluster of impact locations. A length of the major axis and/or a length of the minor axis may be determined as well. The eccentricity analysis may provide an indication of whether range errors or errors on azimuth predominate for a given "impact cluster"; i.e., a plurality of impact locations.

FIG. 5B depicts an analyzed-impact-location graph 550. The analyzed-impact-location graph 500 and analyzed-impact-location graph 550 show results from similar, but not the same, simulation. FIG. 5B shows results of firing a 120 mm mortar with a charge of 4, where FIG. 5A shows results of firing a 120 mm mortar with a charge of 0. A charge of 4 may be the maximum amount of charge provided to a projectile, in comparison to a charge of 0 which may be the minimum amount of charge provided to a projectile.

Range axis 570 of FIG. 5B indicates that the target 580 is approximately 7080 meters from the simulated weapon system and deflection axis 560 of FIG. 5B ranges from −300 meters to +300 meters. As such, deflection axis 560 and range axis 570 of FIG. 5B are on larger scales compared to deflection axis 510 and range axis 520 of FIG. 5A, indicating both a longer range and more deflection for impact locations 582 of FIG. 5B compared to impact locations 532 of FIG. 5A.

By running several simulations and comparing multiple impact-location graphs, the simulation engine may predict real-world effects. For example, a comparison may be made for a first distance between an MPI and a target in a first simulation to a second distance between an MPI and a target in a second simulation where the target is farther away from the weapon platform. FIG. 5A shows the distance between MPI 540 and target 530 is approximately 10 meters and FIG. 5B shows the distance between MPI 590 and target 580 is approximately 100 meters. As the comparison determines that the second distance increases, the use of the two simulations indicates a real-world effect that there is increased difficulty in clustering impact locations on a distant target.

Further, other statistical results may indicate increased difficulty in trying to cluster impact locations on a more distant target. For example, the bias and CEP in FIG. 5B of 92.0212 meters and 106.6353 meters, respectively, are each greater than the bias and CEP of FIG. 5A of 12.2565 meters and 37.652 meters, respectively. The increase in bias and CEP may indicate the increased effect of small errors in the weapon system have on longer trajectories. Further, the one-sigma and two-sigma values are larger as well in FIG. 5B in comparison to FIG. 5A: the one-sigma radius of one-sigma circle 594 and the two-sigma radius of two-sigma circle 596 are approximately 130 meters and 210 meters, respectively. Each of those values is larger than the corresponding values of FIG. 5A which has the one-sigma radius of one-sigma circle 544 is approximately 50 meters and the two-sigma radius of two-sigma circle 546 is approximately 80 meters.

By isolating errors and/or changing other parameters selectively, different comparisons between weapon system components, projectiles, MET effects, and the like can be made. The various comparisons may be useful in making design choices of a weapon system, making tactical decisions based on effects of different types and amounts of propellant and projectiles, and/or the effects of weather, as well as providing a graphical display of impact locations under various conditions that may used while training or otherwise informing soldiers about a weapon system.

Figure 6:
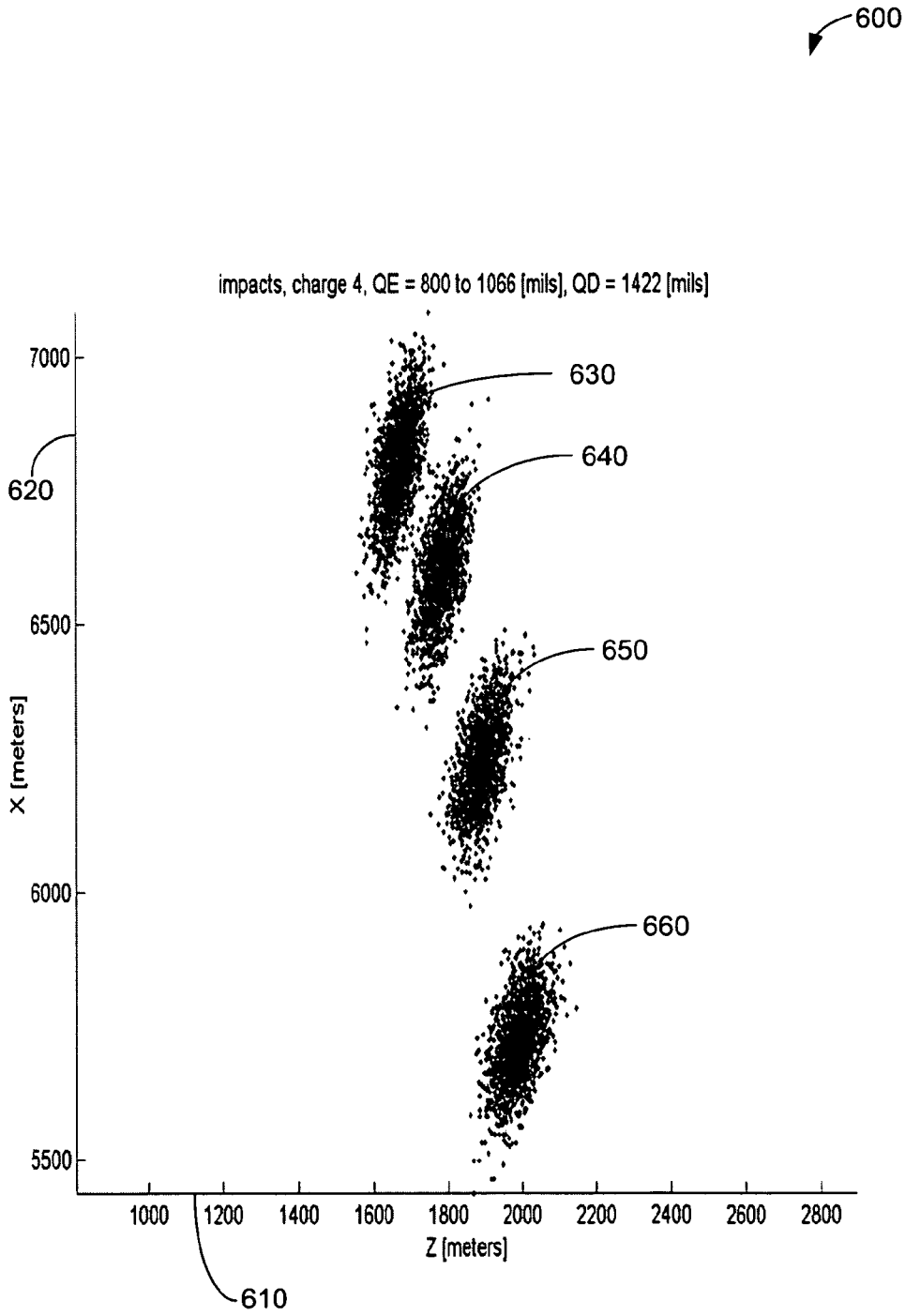
FIG. 6 depicts example results of simulated firing of a weapon system indicating unexpected impact locations, in accordance with embodiments of the invention.

FIG. 6 depicts example results of simulated firing of a weapon system indicating unexpected impact locations, in accordance with embodiments of the invention. FIG. 6 depicts an impact-location graph 600 with a horizontal axis 610, a vertical axis 620, and four impact clusters 630, 640, 650, and 660.

An impact-location graph may indicate results for a range of targeting settings of a weapon system. FIG. 6 shows impact locations for projectiles with a charge level of 4 as indicated as "charge 4", a deflection of 1422 mils (or approximately 10° from the reference azimuth of 1600 mils) as indicated with "QD=1422 [mils]", and a range of elevations from 800 mils (45°) to 1066 mils (60°) as indicated with "QE=800 to 1066 [mils]." The horizontal axis 610 indicates a maximum elevation of a projectile along a simulated trajectory and the vertical axis 620 indicates a range of a projectile.

FIG. 6 shows the four impact clusters 630-660, each corresponding to a selection of an azimuth of 1422 mils, with the impact cluster 630 corresponding to a selection of an elevation of 800 mils, the impact cluster 640 corresponding to a selection of an elevation of approximately 889 mils (50°), the impact cluster 650 corresponding to a selection of an elevation of approximately 978 mils (55°), and the impact cluster 660 corresponding to a selection of an elevation of 1066 mils. As expected, FIG. 6 shows the maximum elevation (along the horizontal axis 610) of each impact cluster increasing as the selected elevation increases. For example, FIG. 6 shows the average maximum elevation of the impact cluster 630 is approximately 1650 meters, the average maximum elevation of the impact cluster 640 is approximately 1775 meters, the average maximum elevation of the impact cluster 650 is approximately 1850 meters, and the average maximum elevation of the impact cluster 660 is approximately 2000 meters.

The ballistic equations of motion and FIG. 6 both indicate that shots fired at 800 mils will have the maximum range over all settings of elevation. However, in examining impact clusters 630 and 640, the average range of impacts in the impact cluster 640 is slightly longer than expected in comparison to the average range of impacts in the impact cluster 630. This indicates that range variations or errors have a somewhat greater effect on precision and impact zone eccentricities for long shots (low tube angles) then they do for high angle shots.

This unexpected effect previously went unnoticed, most likely due to the difficulty of determining exact impact locations and the cost and difficulty in firing large numbers of projectiles. Using computerized simulation and detailed modeling of error sources in a weapon system, the present application describes techniques for precisely and cheaply determining impact locations for a large number of simulated shots. The precise determination of a large number of impact locations can lead to unexpected results not predicted by other methods of system performance analysis.

An Example Computing Device

Figure 7:
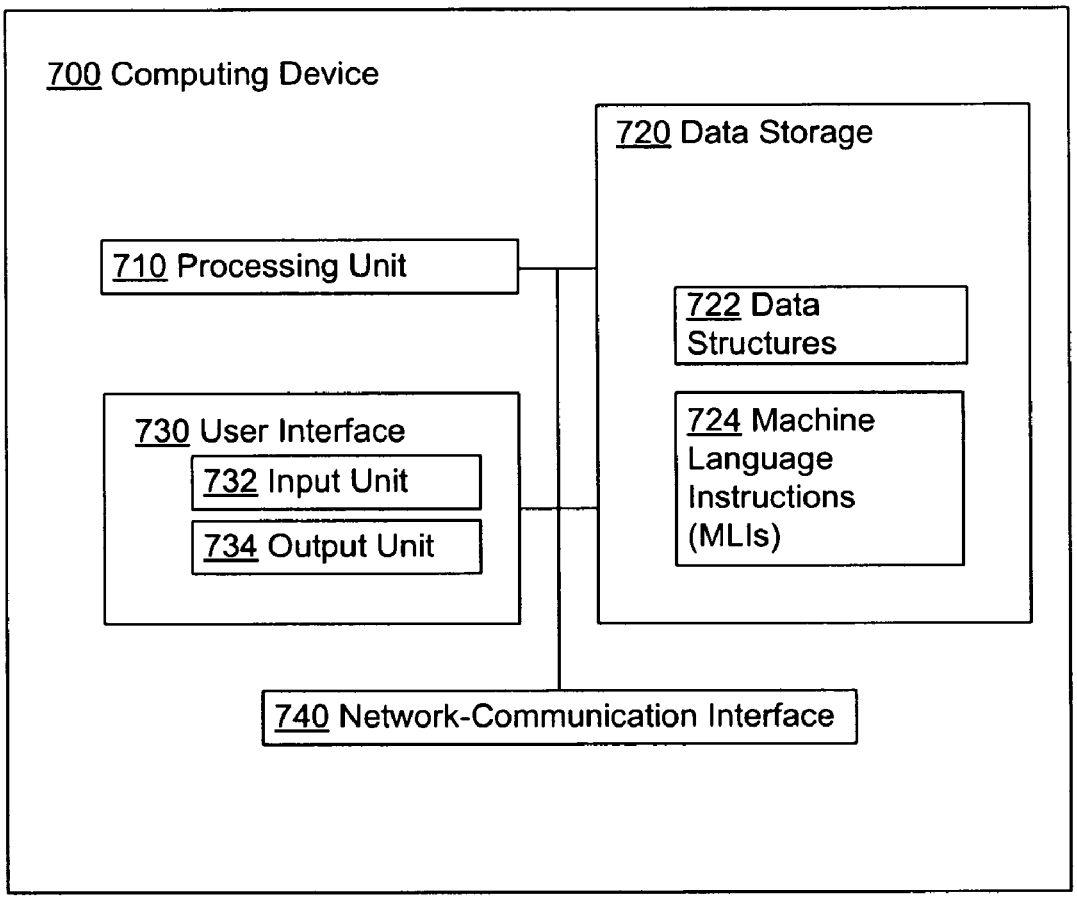
FIG. 7 is a block diagram of an example computing device, in accordance with embodiments of the invention.

FIG. 7 is a block diagram of an example computing device, in accordance with embodiments of the invention. FIG. 7 shows the computing device 700, comprising a processing unit 710, data storage 720, a user interface 730, and a network-communication interface 740, in accordance with embodiments of the invention. A computing device 700 may be a desktop computer, laptop or notebook computer, personal data assistant (PDA), mobile phone, or any similar device that is equipped with a processing unit capable of executing computer instructions that implement at least part of the herein-described method 300, method 900, and/or the herein-described functionality of a ballistics and/or simulation engine(s).

The processing unit 710 may include one or more central processing units, computer processors, mobile processors, digital signal processors (DSPs), microprocessors, computer chips, and similar processing units now known and later developed and may execute machine-language instructions and process data.

The data storage 720 may comprise one or more storage devices. The data storage 720 may include read-only memory (ROM), random access memory (RAM), removable-disk-drive memory, hard-disk memory, magnetic-tape memory, flash memory, and similar storage devices now known and later developed. The data storage 720 comprises at least enough storage capacity to contain data structures 722, and machine-language instructions 724. The data structures 722 comprise at least the herein-described system-state data structure, the correlation matrix, and the error weighting function. The machine-language instructions 724 contained in the data storage 720 include instructions executable by the processing unit 710 to perform some or all of the functions of a herein-described ballistics and/or simulation engine(s), and/or to perform some or all of the procedures described in method 300 and/or method 900.

The user interface 730 may comprise an input unit 732 and/or an output unit 734. The input unit 732 may receive user input from a user of the computing device 730. The input unit 732 may comprise a keyboard, a keypad, a touch screen, a computer mouse, a track ball, a joystick, and/or other similar devices, now known or later developed, capable of receiving user input from a user of computing device 700. The output unit 734 may provide output to a user of the computing device 700. The output unit 734 may comprise one or more cathode ray tubes (CRT), liquid crystal displays (LCD), light emitting diodes (LEDs), displays using digital light processing (DLP) technology, printers, light bulbs, and/or other similar devices, now known or later developed, capable of displaying graphical, textual, and/or numerical information to a user of computing device 700.

The network-communication interface 740 is configured to send and receive data and may include a wired-communication interface and/or a wireless-communication interface. The wired-communication interface, if present, may comprise a wire, cable, fiber-optic link or similar physical connection to a wide area network (WAN), a local area network (LAN), one or more public data networks, such as the Internet, one or more private data networks, or any combination of such networks. The wireless-communication interface, if present, may utilize an air interface, such as an IEEE 802.11 (e.g., Wi-Fi) interface to a WAN, a LAN, one or more public data networks (e.g., the Internet), one or more private data networks, or any combination of public and private data networks.

The computing device 700 may perform functions as described as being performed by a simulation engine within the present application. For example, the machine language instructions 724 may be executed by the processing unit 710 to perform some or all of the functions shown in FIG. 3 above and/or FIG. 9 below.

An Example System-State Data Structure

FIG. 8 is a schematic diagram of an example system-state data structure. The system-state data structure may be used by a simulation engine to compile a record of a simulation in performing the functions shown in FIG. 3 above and/or FIG. 9 below. The record of the simulation may comprise inputs, intermediate values (including those generated by Monte Carlo techniques), and outputs of the ballistics and/or simulation engine(s). FIG. 8 shows a system-state data structure 800 with a number of simulated shots 810, a DESD 820, per-shot data 830, post-processing data 870, and MET effects data 880. Note that the system-state data structure 800 may comprise more or fewer sub-structures than described herein.

The number of simulated shots 810 may indicate a quantity of shots to be simulated by a ballistics engine. The DESD 820 may comprise a plurality of error terms with an error term for each of N error sources. FIG. 8 shows the DESD 820 comprising a plurality of error terms with error terms for error source one 822 through error source N 824.

Each error term may be indicated as enabled or disabled and the system-state data structure may store information about the enabled/disabled status of each error term. FIG. 8 shows error term flags 826 usable to store the enabled/disabled status of each error term. For example, if the flag value for an error source is set to "yes", the error term for that error source is enabled; but if the flag value for the error source is set to "no", the error term for that error source disabled.

FIG. 8 indicates the per-shot data 830 comprises information about each simulated shot fired by the ballistics engine including a time of shot 832, weapon-system data 840, projectile data 850, and trajectory data 860. The time of shot 832 may describe when a simulated projectile was fired.

FIG. 8 shows the weapon-system data 840 with a weapon-system location 842, targeting data 844, and error values 846. The weapon-system location 842 may comprise coordinates for a weapon system, such as, but not limited to, map coordinates, polar coordinates, spherical coordinates, Cartesian coordinates, latitude/longitude information, and/or height above sea level information. Targeting data 844 may comprise coordinates using a coordinate system such as described for the weapon-system location 842, which may be the same or a different coordinate system than used for the weapon-system location 842. The error values 846 may comprise an error value for each error term of DESD 820 for each shot of the number of simulated shots 810. Each error value in error values 846 may be determined via a Monte Carlo technique.

Projectile data may comprise information about a simulated projectile fired for a given round. FIG. 8 shows projectile data 850 with a charge level 852, a type of propellant 854, and size of projectile 856. Trajectory data may comprise information about a simulated trajectory of a given round. FIG. 8 shows trajectory data 860 with an initial velocity 862 and an impact location 864. The initial velocity 862 may comprise the initial velocity of a simulated projectile for a given shot. The impact location 864 may comprise a location where the simulated projectile landed after being fired.

The system-state data structure may comprise performance parameters. Performance parameters may include parameters and/or other data determined after simulating a number of shots being fired, including one or more statistical results of impact locations. FIG. 8 shows performance parameters comprising a CEP 872, a bias 874, a one-sigma value of impact locations 876, a two-sigma value of impact locations 878, and an MPI 879.

The MET effects data 880 may comprise information about various components of weather conditions during the firing of simulated projectiles. FIG. 8 shows the MET effects data 880 with wind conditions 882, precipitation level 884, temperature 886, humidity 888, air pressure 890, and visibility information 892. MET effects data may indicate constant weather conditions throughout the simulation or may indicate weather conditions that vary over time during the simulation. For example, if rounds are to be fired on a sunny 20° C. day having 30% humidity with a constant 10 km/hour wind from the east, the MET effects data 880 would indicate constant weather conditions throughout the simulation.

MET effects may vary with altitude. The temperature changes with altitude (which affect pressure, hence air density, and thus ballistics) are termed the International Standard Atmosphere (ISA) Lapse rates. The ISA Lapse rates may be determined by the simulation and/or the ballistics engine(s). The wind may change velocity and direction depending on the altitude. These wind effects may be modeled and simulated by the simulation and/or the ballistics engine(s).

A simulation may be run where weather conditions vary over time. A simulation engine may allow for weather conditions that vary over time by storing time-dependent values of each component (e.g., wind conditions 882) of MET effects data 880 for each change in weather as well as specifying a time for the components as time 894. The time of shot 832 may then be compared to each time 894 in MET effects data to determine which MET effects at time of shot 832. For example, suppose that two weather conditions are to be simulated:

1. From time 10:00 to time 11:00, the weather conditions are a sunny 20° C. day having 30% humidity with a constant 10 km/hour wind from the east.

2. From time 11:00 and beyond, the weather conditions are a sunny 20° C. day having 30% humidity with a constant 10 km/hour wind from the north.

Then, if a time of shot 832 is 10:30, the weather conditions are a sunny 20° C. day having 30% humidity with a constant 10 km/hour wind from the east. But if the time of shot 832 is 11:30, the weather conditions are a sunny 20° C. day having 30% humidity with a constant 10 km/hour wind from the north.

An Example Method for Determining an Error-Weighting Function

Figure 9A:
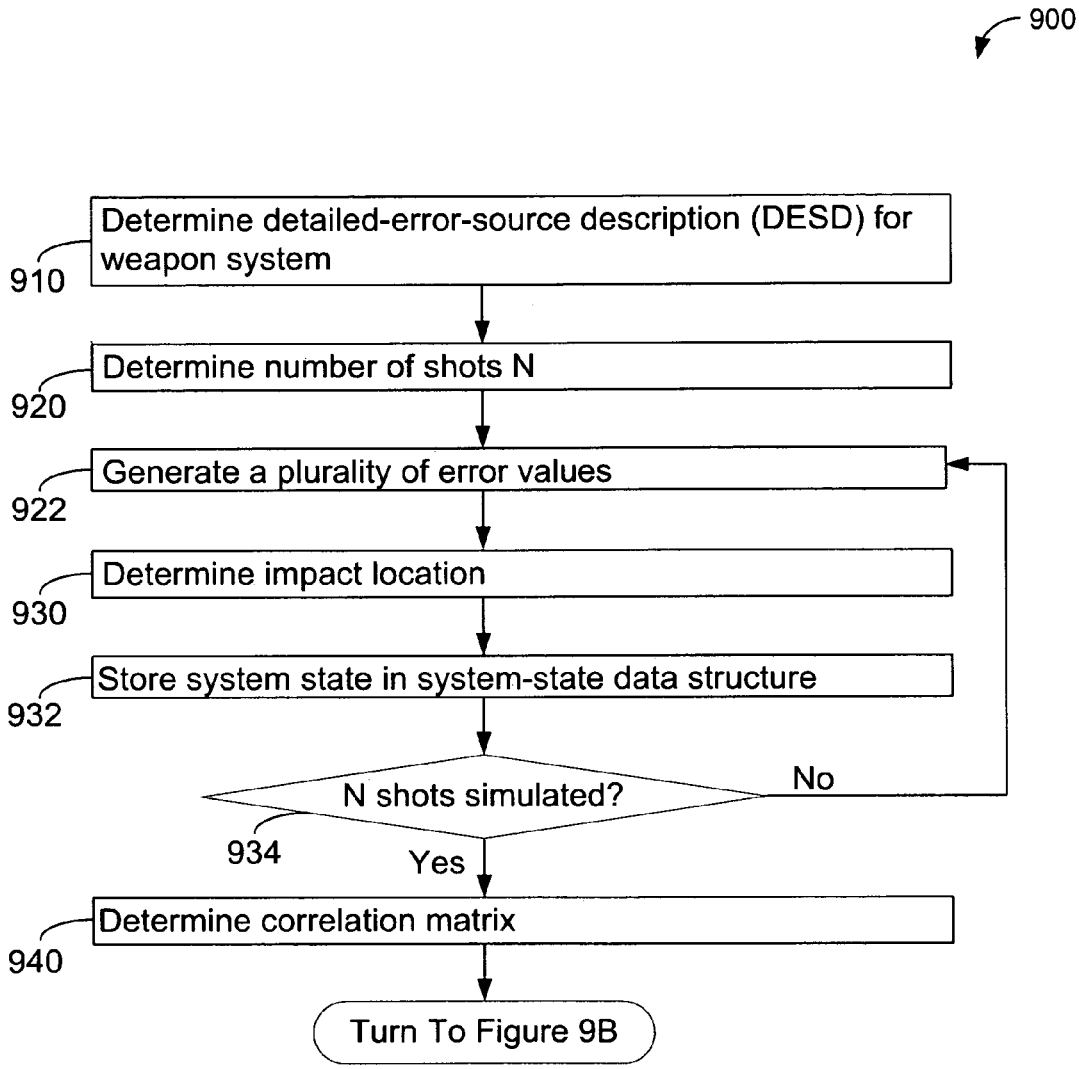
FIGS. 9A and 9B are a flowchart of an example method, in accordance with embodiments of the invention.
Figure 9B:
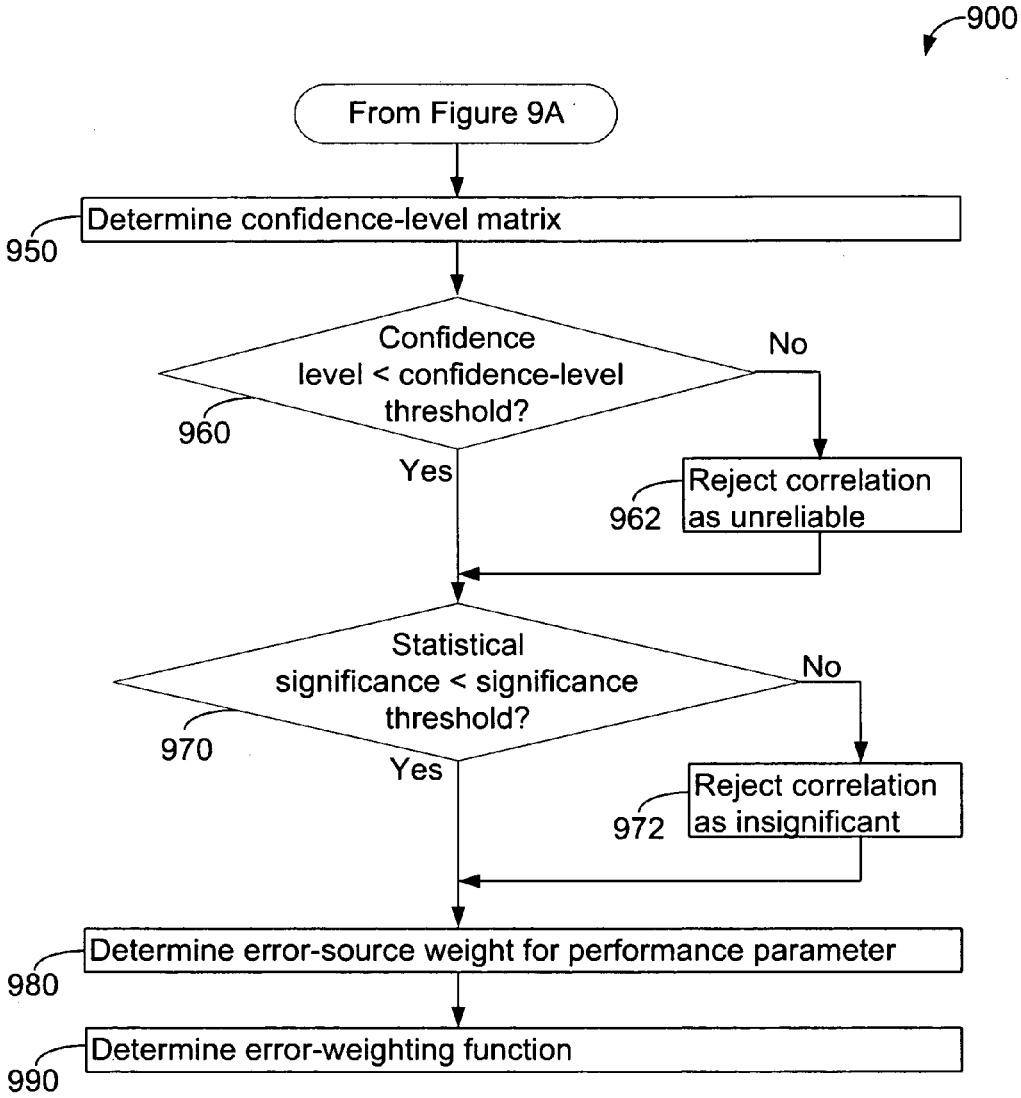

FIGS. 9A and 9B together are a flowchart of an example method 900, in accordance with embodiments of the invention.

Turning to FIG. 9A, the method 900 begins at block 910. At block 910, a DESD may be determined for a weapon system. The DESD may comprise a plurality of error terms, where each error term describes an error source in the weapon system. The DESD may be a stand-alone data structure or may be part of a larger data structure, such as detailed-error-source-description 820 in system-state data structure 800. Each error term may model an error source using a descriptive statistical formula of expected errors, such as a Gaussian distribution of expected errors, a bimodal distribution of expected errors, or a uniform distribution of expected errors.

At block 920, a number of shots N may be determined for the weapon system. N may be determined via user input or may be determined algorithmically. An algorithmic determination of N may be based on a sum of absolute values of differences in correlation matrices. Other algorithms may be used to determine N as well.

At block 922, an error value for each error term in the DESD may be generated. Each error value in the plurality of error values may be generated by applying a Monte Carlo technique to an error term in the DESD. An example Monte Carlo technique for determining an error value corresponding to an error term in the DESD is: (1) determine a random (or pseudo-random) value for each input parameter of the error term, (2) determine a corresponding output value of the error term based on the random input parameters, and (3) use the corresponding output value as the error value. This Monte Carlo technique may be repeated to determine an error value for each error term in the DESD. Note that this Monte Carlo technique may be used to generate a different set of error values for each simulated test of the weapon system, as each error value is determined using a formula (e.g. the error term) that receives random or pseudo-random inputs.

Each error term in the DESD may be enabled or disabled, including the model of MET effects. Providing the ability to disable one or more error terms permits examination of a smaller set of error sources, such as required for a detailed examination of one or more aspects of the weapon system.

One technique for disabling an error source is to set the error source to a constant; i.e., using an error term for the error source that has an output of a constant value regardless of input value. For MET effects, a default set of MET effects (e.g., a sunny, windless day with a humidity of 30% and a temperature of 20° C.) may be used as a constant.

Another technique for enabling or disabling an error source is to maintain and examine a value, such as an error term flag, for each error source that indicates if the error source should be used. User input may be used to determine the error term flags. The error term flags may be stored as well, such as in a system-state data structure.

At block 930, an impact location may be determined. The impact location may be determined by simulating the firing of a shot by the weapon system.

At block 932, a system state for the weapon system during the test may be stored. The system state for the weapon system comprises the information used in simulating performance of the weapon system. Specifically, the system state comprises the plurality of error values and the impact location. The system state may comprise MPI effects data and/or any additional system parameters as well, such as tube elevation, propellant charge, and the like. Other performance parameters beyond the impact location may be stored in the system state as well, such as a CEP, bias, one-sigma, two-sigma, and MPI. The system state may be stored in a system-state data structure, such as system-state data structure 800.

At block 934, a determination may be made if N shots of the weapon system have been simulated. If N shots have not been simulated, the method 900 may proceed to block 922. If N shots have been simulated, the method 900 may proceed to block 940.

At block 940, a correlation matrix, based on the system-state data structure, may be determined. The correlation matrix provides a numerical value indicating the statistical correlation between any two correlation-matrix parameters. The correlation matrix may be generated for each possible pair of correlation-matrix parameters in the system-state data structure.

Turning to FIG. 9B, at block 950, a confidence-level matrix, based on the system-state data structure, may be determined. The confidence-level matrix may provide confidence levels for each correlation in the correlation matrix, and thus be coordinated with the correlation matrix. For example, a correlation at location (i,j) of the correlation matrix that indicates a correlation between correlation-matrix parameter i and correlation-matrix parameter j may have a corresponding confidence level at location (i,j) in the confidence-level matrix that indicates a confidence level of the correlation at location (i,j) of the correlation matrix. The confidence-level for a correlation may depend on the value of the number of shots N.

At block 960, the confidence levels in the confidence-level matrix may be compared to a confidence-level threshold. As each confidence level in the confidence-level matrix corresponds to a correlation in the correlation matrix, comparing the confidence levels in the confidence-level matrix to the confidence-level threshold is equivalent to comparing the confidence of correlations in the correlation matrix to the confidence-level threshold. For each confidence level less than the confidence-level threshold, method 900 may proceed to block 962. For each confidence level greater than or equal to the confidence-level threshold, method 900 may proceed to block 970.

At block 962, correlations in the correlation matrix may be rejected as unreliable. The rejected correlations may correspond to confidence levels in the confidence-level matrix that are less than the confidence-level threshold. Rejecting correlations in the correlation matrix as unreliable eliminates the contribution of the correlation-matrix parameter in question to an error-weighting function. One technique to reject a correlation as unreliable is to set the correlation to zero. After executing block 962, method 900 may proceed to block 970.

At block 970, the statistical significance of correlations in the correlation matrix may be compared to a significance threshold. The statistical significance of a correlation may be determined with respect to a performance parameter. Example performance parameters include the accuracy, precision, the azimuth error, and the range error. Other performance parameters are possible as well.

For each correlation with a statistical significance less than the significance threshold, method 900 may proceed to block 972. For each correlation with a statistical significance greater than or equal to the significance threshold, method 900 may proceed to block 980.

At block 972, a correlation may be rejected as insignificant. Rejecting the correlation as insignificant eliminates the contribution of the parameter in question to an error-weighting function. One technique to reject a correlation as insignificant is to set the correlation to zero.

At block 980, one or more error-source weights may be determined. Each error-source weight may be based on the correlations that have been determined to be both reliable and statistically significant with respect to a given performance parameter. Each error-source weight may be determined by normalizing the correlations (for those correlations determined to be reliable and significant) for the given performance parameter. These normalized values are assigned as error weights to their respective error terms. As another example, the error-source weight may be determined by performing arithmetic or other mathematical operations on the error-source effect.

At block 990, an error-weighting function is determined based on the error-source weights. An example error-weighting function is a sum of the normalized error-source weights. After completing block 990, method 900 ends.

Exemplary embodiments of the present invention have been described above. Those skilled in the art will understand, however, that changes and modifications may be made to the embodiments described without departing from the true scope and spirit of the present invention, which is defined by the claims. It should be understood, however, that this and other arrangements described in detail herein are provided for purposes of example only and that the invention encompasses all modifications and enhancements within the scope and spirit of the following claims. As such, those skilled in the art will appreciate that other arrangements and other elements (e.g. machines, interfaces, functions, orders, and groupings of functions, etc.) can be used instead, and some elements may be omitted altogether.

Further, many of the elements described herein are functional entities that may be implemented as discrete or distributed components or in conjunction with other components, in any suitable combination and location, and as any suitable combination of hardware, firmware, and/or software.

The invention claimed is:

1. A method for determining a performance result of a weapon system, the method comprising:

determining a detailed-error-source description (DESD) of the weapon system, wherein the DESD comprises a plurality of error terms and wherein each error term is a model of an error source of the weapon system;

determining a target of the weapon system;

generating a plurality of error values, wherein each error value is based on an error term of the DESD;

simulating a firing of a shot by the weapon system based on the plurality of error values;

storing an impact location of the shot and the plurality of error values in a system-state data structure;

determining the performance result of the weapon system based on the system-state data structure and determining a correlation matrix based on the system-state data structure.

2. The method of claim 1, further comprising determining a meteorological-effects data structure.

3. The method of claim 2, wherein simulating a firing of a shot by the weapon system comprises simulating a firing of a shot by the weapon system based on the meteorological-effects data structure.

4. The method of claim 1, wherein the performance result comprises the impact location of the shot.

5. The method of claim 1, wherein the performance result comprises a determination of aggregate behavior of a plurality of impact locations for the weapon system aimed at the target.

6. The method of claim 5, wherein the aggregate behavior comprises a bias, wherein the bias is a distance between the target and a mean impact location of the plurality of impact locations.

7. The method of claim 5, wherein the aggregate behavior comprises a circular error probable (CEP), wherein the CEP is a radius of a circle, centered at the target, within which approximately 50% of the plurality of impact locations lies.

8. The method of claim 5, wherein the aggregate behavior comprises a standard deviation of a distance between the target and the plurality of impact locations.

9. The method of claim 1, further comprising determining a location of the weapon system.

10. The method of claim 1, wherein determining the target of the weapon system comprises determining an azimuth and an elevation of the target.

11. The method of claim 1, wherein the detailed-error-source description comprises an error term comprising a descriptive statistics model of an error source.

12. The method of claim 1, wherein the detailed-error-source description comprises an error term comprising a collection of empirical data.

13. A simulation engine, comprising:

a processor;

a user interface;

data storage;

machine language instructions stored in the data storage and executable by the processor to perform functions comprising:

determining a detailed-error-source description (DESD) of a weapon system, wherein the DESD comprises an error term for each of N error sources in the weapon system;

receiving a target for the weapon system;

receiving a number of simulated shots of the weapon system; and for each shot in the number of simulated shots:

(i) determining an error value for each error term of the DESD, (ii) determining an impact location of the shot, (iii) storing the error value for each error term and the impact location in a system-state data structure; and determining a correlation matrix based on the system-state data structure.

14. The simulation engine of claim 13, wherein the correlation matrix is a P×P matrix of correlations, where P=N+M, N is a number of error term values, and M is a number of additional system parameters, wherein each correlation in the correlation matrix is determined by correlating correlation-matrix parameters, and wherein a correlation at a location (i, j) of the correlation matrix, $1 \leqq i, j \leqq P$, indicates a statistical relationship between correlation-matrix parameter i and correlation-matrix parameter j.

15. The simulation engine of claim 13, wherein the machine language instructions further comprise instructions to determine an eccentricity analysis of the impact locations of multiple shots in the number of shots.

16. The simulation engine of claim 13, wherein the machine language instructions further comprise instructions to determine an error-weighting function based on the correlation matrix.

17. The simulation engine of claim 16, wherein the machine language instructions to determine an error-weighting function based on the correlation matrix comprise machine language instructions to determine an error-source weight of the error-weighting function.

18. The simulation engine of claim 16, wherein the machine language instructions to determine an error-weighting function based on the correlation matrix comprise machine language instructions to determine a confidence level for each correlation in the correlation matrix.

19. The simulation engine of claim 18, wherein the machine language instructions to determine an error-weighting function based on the correlation matrix comprise machine language instructions to compare the confidence level of the correlation to a confidence-level threshold, and wherein the machine language instructions to determine an error-weighting function based on the correlation matrix comprise machine language instructions to, responsive to a determination that the confidence level of the correlation is less than the confidence-level threshold, reject the correlation as unreliable.

20. A method for determining an error-weighting function of a weapon system, the method comprising:

determining a detailed-error-source description (DESD) of the weapon system, wherein the DESD comprises a plurality of error terms, wherein at least one error term in the plurality of error terms comprises a descriptive statistics model of an error source of the weapon system;

determining a number of shots to be simulated;

for each shot in the number of shots to be simulated:

(i) generating a plurality of error values using a Monte Carlo technique, (ii) simulating a firing of a shot by the weapon system to determine an impact location, and (iii) storing a system state in a system-state data structure, wherein the system state comprises the plurality of error values, a plurality of additional system parameters, and the impact location;

determining a correlation matrix and a confidence-level matrix, based on the system-state data structure;

comparing confidence levels for correlations in the confidence-level matrix to a confidence-level threshold;

responsive to determining that a confidence level in the confidence-level matrix is less than the confidence-level threshold, rejecting a correlation corresponding to the confidence level as unreliable;

determining the statistical significance of the correlations in the correlation matrix with respect to a performance parameter;

comparing the statistical significance for the correlations in the correlation matrix to a significance threshold;

responsive to determining that the statistical significance of a correlation in the correlation matrix is less than the significance threshold, rejecting the correlation as insignificant;

determining a plurality of error-source weights for the performance parameter, wherein the plurality of error-source weights are based on each correlation that was not rejected; and determining an error-weighting function for the performance parameter based on the plurality of error-source weights.

* * * * *